US007861691B2

(12) United States Patent
Nakata et al.

(10) Patent No.: US 7,861,691 B2
(45) Date of Patent: Jan. 4, 2011

(54) CONTROLLER FOR ACCUMULATOR FUEL INJECTION SYSTEM

(75) Inventors: Kenichiro Nakata, Anjo (JP); Koji Ishizuka, Chita-gun (JP)

(73) Assignee: Denso Corporation, Kariya (JP)

( * ) Notice: Subject to any disclaimer, the term of this patent is extended or adjusted under 35 U.S.C. 154(b) by 174 days.

(21) Appl. No.: 12/233,800

(22) Filed: Sep. 19, 2008

(65) Prior Publication Data

US 2009/0084356 A1 Apr. 2, 2009

(30) Foreign Application Priority Data

Sep. 28, 2007 (JP) ..... 2007-254983

(51) Int. Cl.
*F02M 69/46* (2006.01)
*F02M 69/54* (2006.01)

(52) U.S. Cl. ..... 123/456

(58) Field of Classification Search ..... 123/456, 123/447, 514, 510, 511, 495
See application file for complete search history.

(56) References Cited

U.S. PATENT DOCUMENTS 6,142,121 A 11/2000 Nishimura et al.
6,192,864 B1 2/2001 Nishimura

FOREIGN PATENT DOCUMENTS

JP 07-119516 5/1995
JP 2006-242091 9/2006
JP 2007-023988 2/2007

OTHER PUBLICATIONS

U.S. Appl. No. 11/930,668 of Ishizuka, filed Oct. 31, 2007.
U.S. Appl. No. 12/179,235 of Ishizuka, filed Jul. 24, 2008.
U.S. Appl. No. 12/186,038 of Nakata, filed Aug. 5, 2008.
U.S. Appl. No. 12/187,638 of Nakata, filed Aug. 7, 2008.
U.S. Appl. No. 12/189,376 of Nakata, filed Aug. 11, 2008.
U.S. Appl. No. 12/194,917 of Nakata filed Aug. 20, 2008.
U.S. Appl. No. 12/195,609 of Nakata filed Aug. 21, 2008.
U.S. Appl. No. 12/194,130 of Nakata filed Aug. 19, 2008.
U.S. Appl. No. 12/197,447 of Nakata filed Aug. 25, 2008.
U.S. Appl. No. 12/201,426 of Nakata filed Aug. 29, 2008.
Japanese Office Action dated Aug. 25, 2009, issued in corresponding Japanese Application No. 2007-254983, with English translation.
U.S. Appl. No. 12/210,409, Koji Ishizuka et al., filed Sep. 15, 2008.
U.S. Appl. No. 12/210,440, Kenichiro Nakata et al., filed Sep. 15, 2008.
U.S. Appl. No. 12/235,917, Kenichiro Nakata et al., filed Sep. 23, 2008.
U.S. Appl. No. 12/236,882, Koji Ishizuka et al., filed Sep. 24, 2008.
U.S. Appl. No. 12/255,936, Koji Ishizuka et al., filed Oct. 22, 2008.
U.S. Appl. No. 12/256,100, Koji Ishizuka et al., filed Oct. 22, 2008.
U.S. Appl. No. 12/258,726, Koji Ishizuka et al., filed Oct. 27, 2008.
U.S. Appl. No. 12/258,750, Koji Ishizuka et al., filed Oct. 27, 2008.

*Primary Examiner*—Mahmoud Gimie
(74) *Attorney, Agent, or Firm*—Nixon & Vanderhye P.C.

(57) ABSTRACT

A common-rail fuel injection system is equipped with a common-rail, a fuel pump 11, and an injector. The fuel pump has a plurality of fuel pumping systems. A pressure sensor is provided at a fuel inlet of the injector. When the fuel pump supplies fuel to each of the fuel pumping systems, an ECU detects a variation in fuel pressure in a fuel passage between the fuel pump and the injector. Based on the detected fuel pressure variation, the ECU computes a pumping characteristic with respect to each of the fuel pumping systems.

20 Claims, 10 Drawing Sheets

CONTROLLER FOR ACCUMULATOR FUEL INJECTION SYSTEM

CROSS-REFERENCE TO RELATED APPLICATION

This application is based on Japanese Patent Application No. 2007-254983 filed on Sep. 28, 2007, the disclosure of which is incorporated herein by reference.

FIELD OF THE INVENTION

The present invention relates to a controller for an accumulator fuel injection system which performs a fuel injection by use of high-pressure fuel accumulated in the accumulator of a common-rail.

BACKGROUND OF THE INVENTION

An apparatus described in JP-10-220272A (U.S. Pat. No. 6,142,121) is proposed as an apparatus of this kind. In a common-rail type fuel injection system constructed of this fuel injection apparatus, fuel pressure-fed from a fuel pump is accumulated in a high-pressure state by a common-rail. Then, the accumulated high-pressure fuel is supplied to the fuel injector of each cylinder through pipes (high-pressure fuel passage) disposed for each cylinder. The common-rail is provided with a specified pressure sensor (rail pressure sensor). This system is constructed in such a way as to control the driving of various devices constructing a fuel supply system on the basis of the output of the sensor from this rail pressure sensor.

In recent years, the need for improving exhaust emission is increasing in a diesel engine for an automobile. A study has been conducted in order to improve accuracy of a fuel pressure control. Under the present circumstances, the fuel supplied to the fuel injector is controlled by adjusting the fuel quantity supplied from the fuel pump to the common-rail according to the engine operation condition of each time.

However, if an error arises in the fuel quantity supplied to the common-rail from the fuel pump, an error arises also in the fuel pressure in the fuel injector, which may deteriorate an exhaust emission. In the fuel pump which has a plurality of plungers for pumping the fuel, an error may arise in fuel pumping quantity for every plunger, which may cause an error in pressure of the fuel supplied to the fuel injector.

SUMMARY OF THE INVENTION

The present invention is made in view of the above matters, and it is an object of the present invention to provide a controller for an accumulator fuel injection system, which is capable of improving a pumping characteristic of a fuel pump to improve the exhaust emission.

According to the present invention, a controller is applied to an accumulator fuel injection system provided with a fuel pump which has a plurality of fuel pumping systems in which a suction and a discharge of a fuel are repeatedly performed at an individual timing along with a rotation of an engine output shaft. Further, the accumulator fuel injection system is provided with an accumulator in which the fuel supplied from the fuel pump is accumulated, and a fuel injector which injects the fuel in the accumulator.

The controller includes a pumping pressure detecting means for successively detecting a variation in a fuel pressure in a fuel passage between the fuel pump and the fuel injector at a respective time of a fuel pumping in the fuel pumping systems. Furthermore, the controller includes a pumping characteristic computing means for computing a pumping characteristic with respect to each fuel pumping system based on the variation in the fuel pressure detected by the pumping pressure detecting means.

In a fuel pump which has a plurality of fuel pumping systems, even if a command pumping quantity is identical in each fuel pumping system, a pumping characteristic (fuel pumping quantity and the like) is different from each other in each fuel pumping system due to a manufacturing dispersion or a deterioration with age. When the fuel pump supplies the fuel to a fuel passage between the fuel pump and the fuel injector, the pressure in the fuel passage increases according to a fuel pumping quantity. If the fuel pumping system has an individual difference, a difference will arise in the pressure variation. According to the present invention, the variation in the fuel pressure can be successively detected, and the transitional pressure variation can be detected with respect to each fuel pumping system. Furthermore, a pumping characteristic can be computed based on the transitional pressure variation with respect to each fuel pumping system. Thus, even if the fuel pumping system has its individual difference, such an individual difference can be properly detected. As the result, the pumping characteristic of the fuel pump can be enhanced and the exhaust emission is improved.

According to another aspect of the present invention, the controller further includes a pumping quantity correction means for correcting a command pumping quantity at the time of fuel pumping with respect to each of the fuel pumping systems based on the pumping characteristic of each fuel pumping system computed by the pumping characteristic computing means. Even if the individual difference (deviation of the pumping characteristic) has arisen for every fuel pumping system, it is possible to cancel the individual difference and to perform the proper fuel pumping. The error of the fuel pressure supplied to the injector can be canceled.

According to another aspect of the present invention, the pumping quantity correction means corrects the command pumping quantity so that a fuel pumping quantity becomes equal to each other in the fuel pumping systems under an identical pumping condition. In this case, a uniform fuel pumping can be performed in a plurality of fuel pumping systems, and the fuel pressure to the fuel injector can be stable.

According to another aspect of the present invention, the controller further comprising an individual difference learning means for computing a learning value indicative of an individual difference of each of the fuel pumping systems based on the pumping characteristic of each fuel pumping system computed by the pumping characteristic computing means, and storing the learning value. When the individual difference (deviation of the pumping characteristic) has occurred regularly for every fuel pumping system, the individual difference can be properly obtained and can be reflected suitably for the fuel pumping control.

According to another aspect of the present invention, the accumulator fuel injection system includes a fuel pressure sensor disposed downstream of a fuel outlet of the accumulator in a fuel passage from the accumulator to an injection port of the fuel injector, and the pumping pressure detecting means detects a variation in the fuel pressure based on the output of the fuel pressure sensor.

According to the above, the fuel pressure sensor is provided near the fuel injector (or inside of the fuel injection valve), and the pressure near the fuel injection port can be detected. Therefore, it becomes possible to perform a proper fuel injection, detecting correctly the fuel pressure which varies due to the fuel pumping.

With the above configuration, following advantages can be obtained. The fuel pressure downstream of the fuel outlet of the accumulator is detected, so that the pressure variation can be detected before being attenuated.

When the internal combustion engine is a multi-cylinder internal combustion, the fuel injectors sequentially inject the fuel in a predetermined order. In such a multi-cylinder engine, the pumping pressure detecting means detects the variation in the fuel pressure based on an output of the fuel pressure sensor provided to the cylinder in which no fuel injection is currently performed.

The high pressure fuel from the fuel pump is supplied to the fuel injector of each cylinder all at once through the accumulator. In the injection cylinder, a pressure fluctuation arises due to fuel injection and fuel pumping by the fuel pump. In no-injection cylinder, a pressure fluctuation arises due to only the fuel pumping. Therefore, according to the output of the fuel pressure sensor of the no-injection cylinder, the pressure variation resulting from fuel pumping of the fuel pump can be detected with sufficient accuracy.

According to another aspect of the present invention, the pumping pressure detecting means detects the variation in the fuel pressure in consideration of differences in the fuel path lengths from the fuel pump to a pressure measuring point by the fuel sensor.

When the fuel pressure sensor is provided for every cylinder in multi-cylinder internal combustion engine, the path length (fuel pipe length) from the fuel pump to the fuel pressure sensor may not be the same, and may be respectively different. In this case, the timing at which the pressure variation arises is different for every cylinder according to each path length. Since the difference in the path length about each fuel pressure sensor is considered and the variation of fuel pressure is detected, the detection accuracy is enhanced about the pressure variation.

According to another aspect of the present invention, the pumping pressure detecting means detects the variation in the fuel pressure based on an average value of the outputs of a plurality of fuel pressure sensors. A dispersion in the output in a plurality of fuel pressure sensors is canceled, and it becomes possible to enhance the detection accuracy about the pressure variation accompanying fuel pumping of the fuel pump.

According to another aspect of the present invention, the pumping characteristic computing means computes an integrated value of a pressure variation quantity indicative of a difference between the fuel pressure before a fuel pumping and the fuel pressure during the fuel pumping with respect to each fuel pumping system. The pumping characteristic computing means computes the pumping characteristic with respect to each fuel pumping system based on the integrated value.

Alternatively, the pumping characteristic computing means computes a variation rate of the fuel pressure after the fuel pumping is started with respect to each fuel pumping system, and the pumping characteristic computing means computes the pumping characteristic of each fuel pumping system based on the variation rate of the fuel pressure.

Alternatively, the pumping characteristic computing means computes a required time from a pressure increase by a fuel-pumping-start to a pressure convergence by a fuel-pumping-termination with respect to each fuel pumping system, and the pumping characteristic computing means computed the pumping characteristic of each fuel pumping system based on the required time.

There is provided an accumulator fuel injection system which includes a pressure-reducing valve for discharging the fuel in the accumulator to reduce the fuel pressure therein. In this system, the controller includes a pressure-reducing pressure detecting means for successively detecting a variation in a fuel pressure in a fuel passage between the accumulator and the fuel injector at a time of pressure-reducing by the pressure-reducing valve, a pressure-reducing characteristic computing means for computing a pressure-reducing characteristic of the pressure-reducing valve based on the variation in the fuel pressure detected by the pressure-reducing pressure detecting means.

Since a pressure-reducing pressure detecting means for successively detecting a variation in a fuel pressure in a fuel passage between the accumulator and the fuel injector, a transitive pressure variation due to a fuel discharge can be detected. Moreover, the pressure-reducing characteristic is computed based on the transitional variation in pressure. Thus, if the pressure-reducing characteristic is deviated, its deviation can be properly detected. As the result, the pressure-reducing characteristic of the pressure-reducing valve can be improved and the emission can be improved.

According to another aspect of the present invention, the controller further includes a pressure-reducing quantity correction means for correcting a command pressure-reducing quantity at the time of pressure-reducing based on the pressure-reducing characteristic computed by the pressure-reducing characteristic computing means. Even if a deviation of the pressure-reducing characteristic has arisen, it is possible to cancel it to perform the proper pressure-reducing. The error of the fuel pressure supplied to the injector can be canceled.

According to another aspect of the present invention, the controller further includes a pressure-reducing characteristic learning means for computing a learning value indicative of a deviation of the pressure-reducing characteristic based on the pressure-reducing characteristic computed by the pressure-reducing characteristic computing means, and storing the learning value. With this configuration, when the deviation of the pressure-reducing characteristic has occurred regularly, the deviation of the characteristic can be properly obtained and can be reflected suitably for the pressure-reducing control.

According to another aspect of the invention, the accumulator fuel injection system includes a fuel pressure sensor disposed downstream of a fuel outlet of the accumulator in a fuel passage from the accumulator to an injection port of the fuel injector. The pressure-reducing pressure detecting means detects the variation in the fuel pressure at a time of discharging the fuel by the pressure-reducing valve on the basis of an output of the fuel pressure sensor.

According to the above, the fuel pressure sensor is provided near the fuel injector (or inside of the fuel injection valve), and the pressure near the fuel injection port can be detected. Therefore, a proper fuel injection can be performed, detecting correctly the fuel pressure varied by pressure-reducing.

According to another aspect of the present invention, the fuel injector is provided to each cylinder of a multicylinder engine, and the pressure-reducing pressure detecting means detects the variation in the fuel pressure in consideration of differences in the fuel path lengths from the pressure-reducing valve to the fuel pressure sensor with respect to each pressure sensor disposed on each cylinder.

Since the difference in the path length about each fuel pressure sensor is considered and the variation of fuel pressure is detected, the detection accuracy is enhanced about the pressure variation due to the pressure-reducing.

According to another aspect of the present invention, the pressure-reducing pressure detecting means detects the variation in the fuel pressure based on an average value of the outputs of a plurality of fuel pressure sensors. With this configuration, dispersion in the output in a plurality of fuel pressure sensors is canceled, and it becomes possible to enhance the detection accuracy about the pressure change accompanying the pressure-reducing (fuel discharge) by the pressure-reducing valve.

According to another aspect of the invention, the pressure-reducing characteristic computing means computes an integrated value of a pressure variation quantity indicative of a difference between the fuel pressure before a pressure-reducing and the fuel pressure during the pressure-reducing, and computes the pressure-reducing characteristic based on the integrated value.

Alternatively, the pressure-reducing characteristic computing means computes a variation rate of the fuel pressure after the pressure-reducing is started, and computes the pressure-reducing characteristic based on the variation rate of the fuel pressure.

Alternatively, the pressure-reducing characteristic computing means computes a required time from a pressure drop by a pressure-reducing-start to a pressure convergence by a pressure-reducing-termination, and computes the pressure-reducing characteristic based on the required time.

BRIEF DESCRIPTION OF THE DRAWINGS

Other objects, features and advantages of the present invention will become more apparent from the following description made with reference to the accompanying drawings, in which like parts are designated by like reference numbers and in which.

DETAILED DESCRIPTION OF EMBODIMENTS

Hereinafter, an embodiment that embodies the present invention will be described with reference to the drawings. An apparatus of this embodiment is mounted in, for example, a common-rail type fuel injection system (system for supplying fuel injected at high pressure) in which a reciprocating diesel engine as an engine for an automobile is controlled. That is, this apparatus is used as an apparatus for injecting and supplying high-pressure fuel (for example, light oil having an injection pressure of about "1400 atm") directly into the combustion chamber of a cylinder of a diesel engine (internal combustion engine).

The outline of the common-rail type fuel injection system according to this embodiment will be described with reference to FIG. 1A multi-cylinder engine (for example, 4-cylinder engine) for a 4-wheel automobile is assumed as the engine of this embodiment. In FIG. 1, respective injectors 20 are fitted in first to fourth cylinders (#1, #2, #3, and #4).

Figure 1:
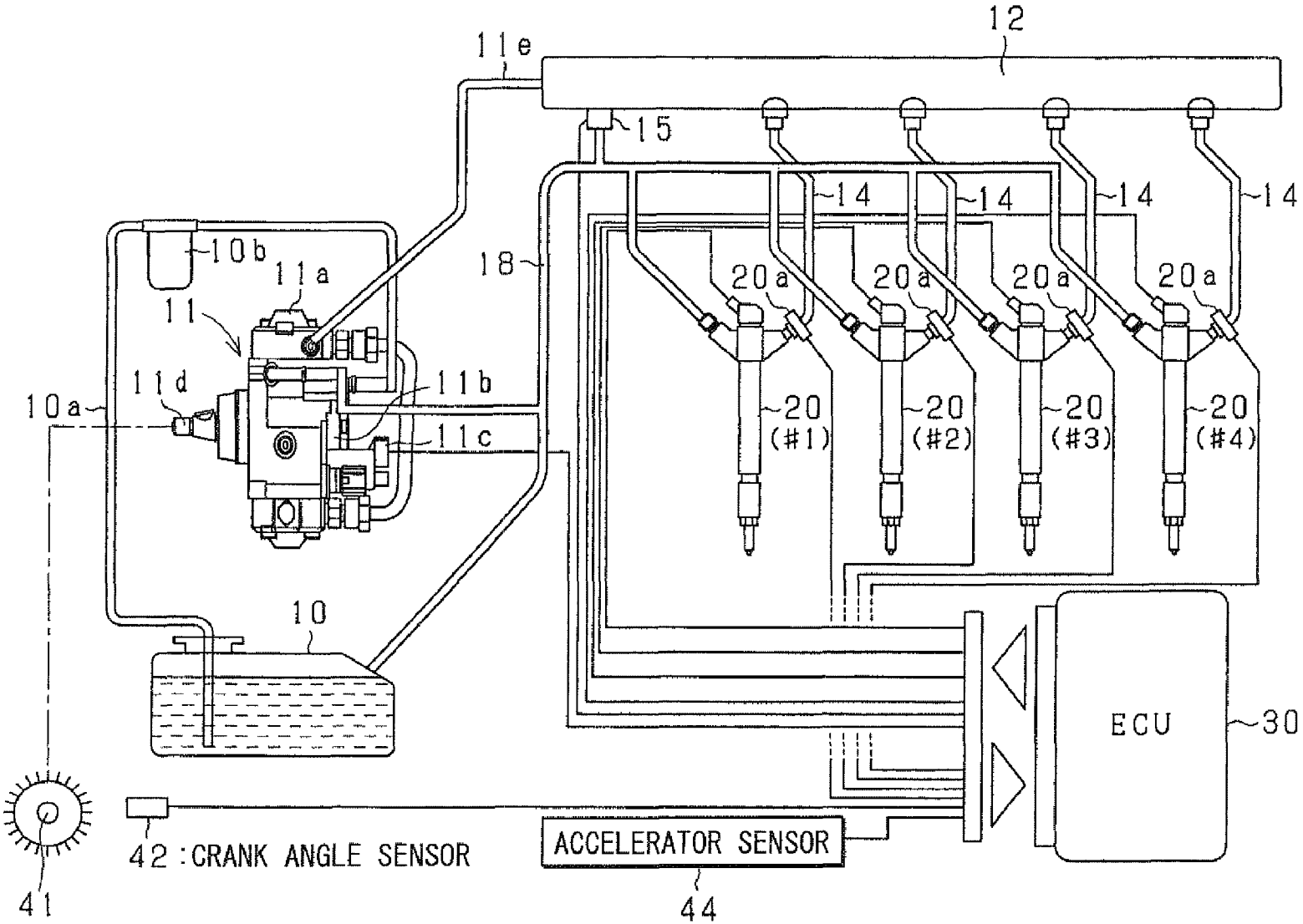
FIG. 1 is a construction view schematically showing a common-rail type fuel injection system in an embodiment of the invention.

As shown in FIG. 1, this system is constructed in such a way that an electronic control unit (ECU) 30 receives sensor outputs (detection results) from various sensors and controls the driving of a fuel supply apparatus on the basis of these respective sensor outputs. In order to control the output (revolution speed or torque) of a diesel engine, for example, the ECU 30 controls various devices constructing a fuel supply system to feed back a fuel injection pressure for the engine (in this embodiment, fuel pressure of the time measured by a pressure sensor 20*a*) to a target value (target fuel pressure).

The various devices constructing the fuel supply system include a fuel tank 10, a fuel pump 11, and a common-rail 12 (accumulation container), which are arranged in this order from the upstream side of fuel flow. The fuel tank 10 and the fuel pump 11 are connected to each other by piping 10*a* via a fuel filter 10*b*.

The fuel tank 10 is a tank (container) for storing the fuel (light oil) of an engine. The fuel pump 11 includes a low-pressure pump 11*a* and a high-pressure pump 11*b* and is constructed in such a way that the fuel suctioned from the fuel tank 10 by the low-pressure pump 11*a* is pressurized and discharged by the high-pressure pump 11*b*. The quantity of fuel pressure-fed to the high-pressure pump 11*b*, that is, the quantity of fuel discharged by the fuel pump 11 is controlled by a suction control valve (SCV) 11*c* disposed on the fuel suction side of the fuel pump 11. In other words, the driving current of the SCV 11*c* is adjusted to control the quantity of discharge of the fuel from the fuel pump 11 to a desired value. The SCV 11*c* is a normally open valve that is opened when the current is not passed.

The low-pressure pump 11*a* is constructed, for example, as a trochoidal feed pump. The high-pressure pump 11*b* is constructed, for example, of a plunger pump and is constructed in such a way that a plurality of plungers (for example, 2 or 3 plungers) are reciprocated respectively in an axial direction by an eccentric cam (not shown) to pump the fuel in a pressuring chamber at specified timing sequentially. Both pumps are driven by a drive shaft 11*d*. The drive shaft 11*d* is rotated in association with a crankshaft 41 of the engine and is rotated, for example, at a ratio of 1/1 or 1/2 with respect to one rotation of the crankshaft 41. That is, the low-pressure pump 11*a* and the high-pressure pump 11*b* are driven by the output of the engine.

Figure 2:
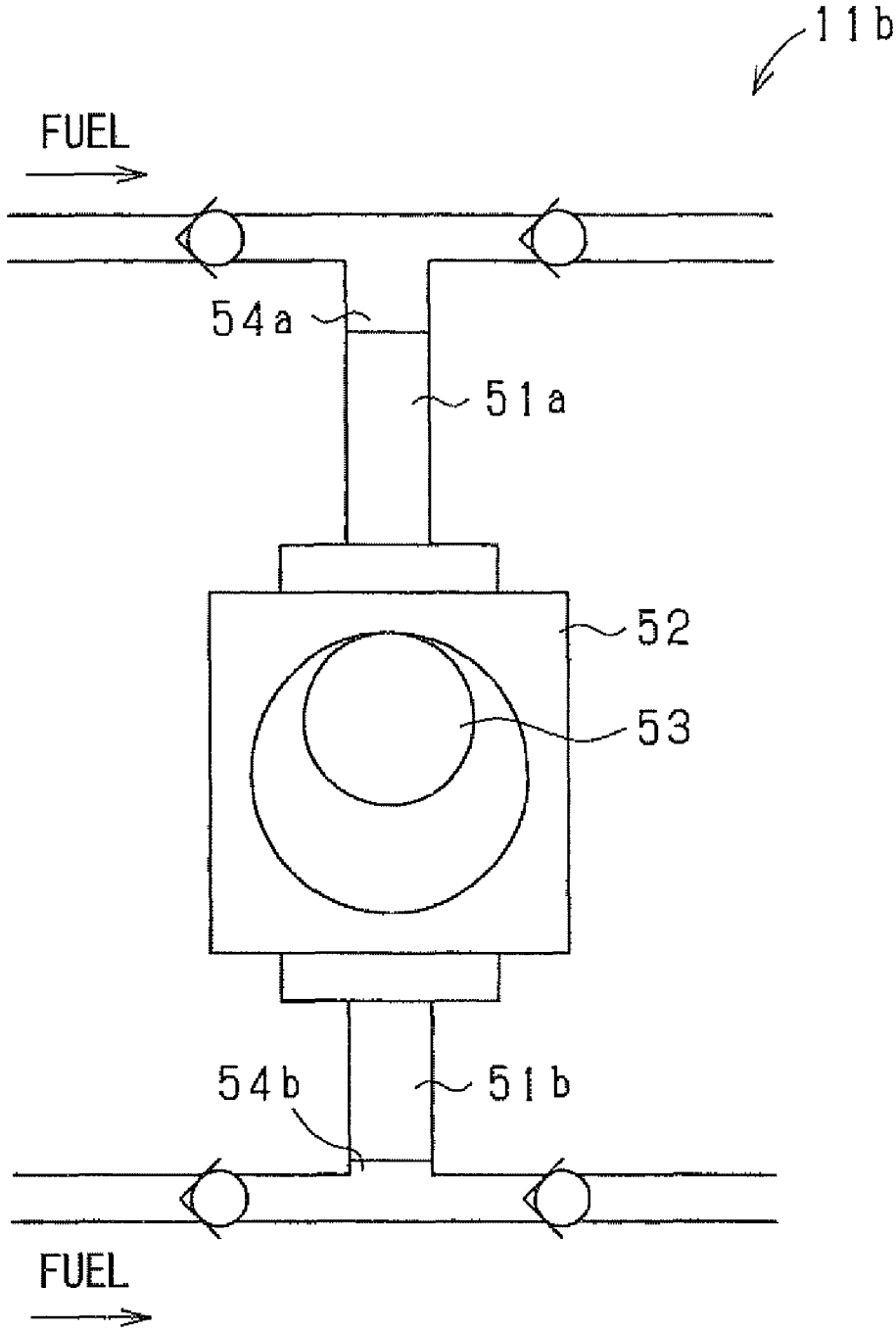
FIG. 2 is a schematic view showing a high-pressure pump.

Referring to FIG. 2, the high-pressure pump 11*b* will be described hereinafter. FIG. 2 shows an essential part of the high-pressure pump 11*b*. The high-pressure pump 11*b* has a first plunger 51*a* and a second plunger 51*b* which reciprocate. Base ends of the plungers 11*a*, 51*b* are in contact with an outer surface of a ring cam 52. The ring cam 52 includes an eccentric cam 53 therein. The eccentric cam 53 is connected to a drive shaft 11*d*. The eccentric cam 53 performs eccentricity rotation, and the ring cam 52 follows it to be displaced. The plungers 51*a* and 51*b* reciprocate, whereby the fuel is introduced into compression chambers 54*a*, 54*b* and the fuel is discharged from the compression chambers 54*a*, 54*b*. In FIG. 2, the first plunger 51*a* is at a bottom dead center and the second plunger 51*b* is at a top dead center.

When the drive shaft 11*d* rotates 180°, the plungers 51*a*, 51*b* discharge the fuel alternately. A plurality of fuel pressure feed systems is configured by a system of the first plunger 51*a* and the compression chamber 54*a* and a system of the second plunger 51*b* and the compression chamber 54*b*.

Referring back to FIG. 1, the fuel in the fuel tank 10 is suctioned by the fuel pump 11 via a fuel filter 10*b* and is pressurized and fed (pressure-fed) to the common-rail 12 through a piping (high-pressure fuel passage) 11*e*. The fuel pressure-fed from the fuel pump 11 is accumulated in the common-rail 12, and the accumulated high-pressure fuel is supplied to the injector 20 of each cylinder through piping (high-pressure fuel passages) 14 disposed for each cylinder. An orifice (a throttling part of the piping 14, which corresponds to fuel pulsation reducing means) for reducing the pulsation of the fuel propagated to the common-rail 12 through the piping 14 is disposed in the connection part 12*a* of the common-rail 12 and the piping 14, whereby the pulsation of pressure in the common-rail 12 is reduced and hence the fuel can be supplied to each injector 20 at a stable pressure. The pulsation of the fuel occurs at the fuel injection port of the injector 20 mainly at the time of injecting the fuel. As for the fuel pulsation reducing means, in addition to the orifice, a flow damper and a combination of the orifice and the flow damper can be applied.

In this system, the fuel pressure-fed by driving the fuel pump 11 is directly injected and supplied into the each cylinder (combustion chamber) of the engine by each injector 20. This engine is a 4-stroke engine. That is, one combustion cycle including 4 strokes of intake, compression, power, and exhaust is performed in sequence at a cycle of "720° CA."

A pressure-reducing valve 15 of the electronic controlled type is provided in the common-rail 12. The pressure-reducing valve 15 is connected to the piping 18. When the pressure-reducing valve 15 is opened, a part of the fuel in the common-rail 12 is discharged into the fuel tank 10 through the piping 18. Therefore, the fuel pressure in the common-rail 12 is decreased.

In the fuel injection apparatus according to this embodiment, a pressure sensor 20*a* (fuel pressure sensor) is disposed near the injector 20 of each of the cylinders (#1 to #4), in particular, at the fuel suction port of the injector 20. The fuel pressure in the injector can be detected with high accuracy (this will be later described in detail).

Figure 3:
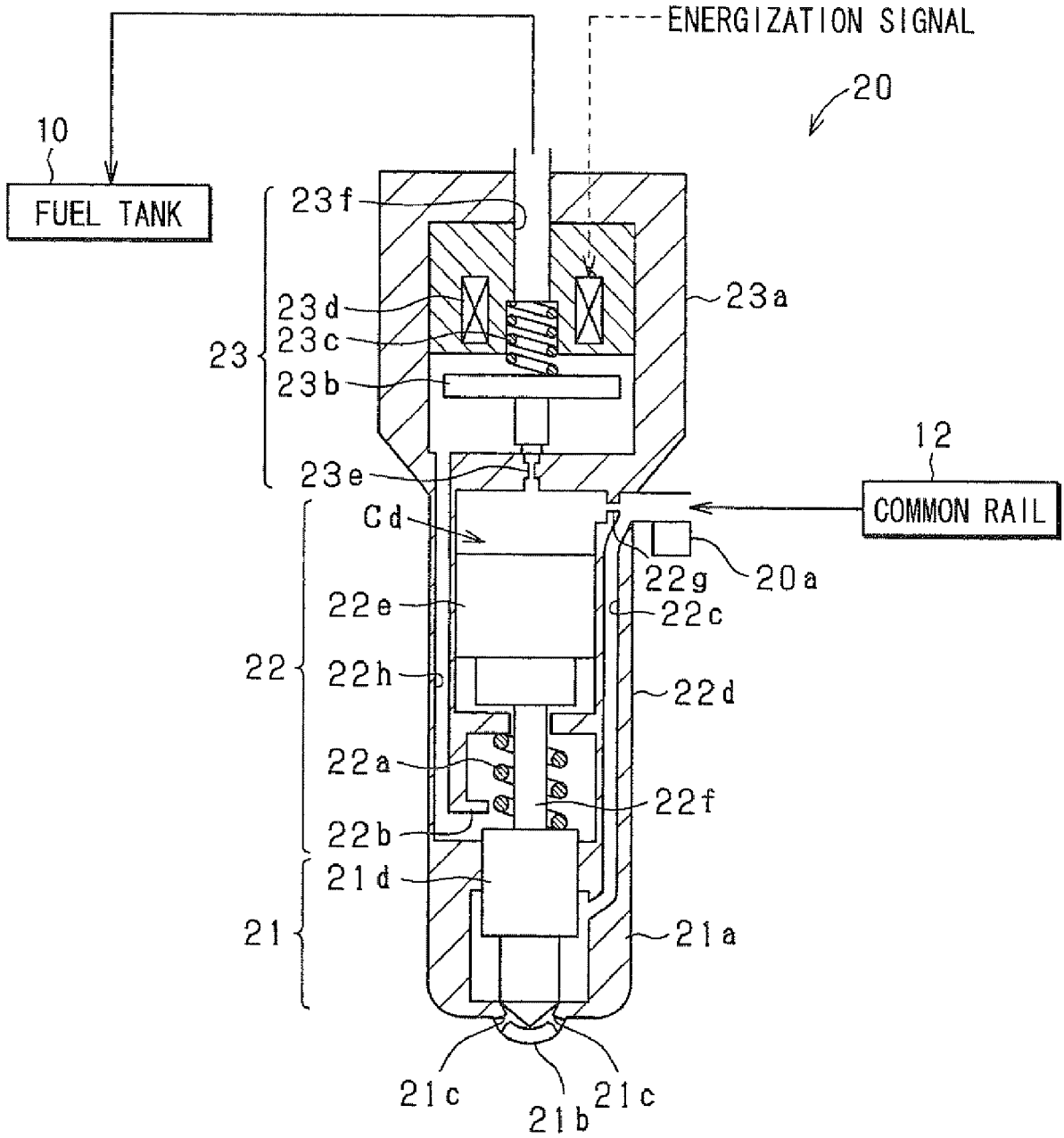
FIG. 3 is a cross sectional view schematically showing an internal structure of an injector.

The structure of the injector 20 will be described in detail with reference to FIG. 3. FIG. 3 is an internal side view schematically showing the internal structure of the injector 20.

As shown in FIG. 3, the injector 20 is constructed of a nozzle part (injection part) 21, which is a part for injecting the fuel to the outside of the valve through the fuel injection port, and a driving part 23 for driving a valve. The nozzle part 21 and the driving part 23 are arranged respectively on the tip end side and the rear end side of a valve body part 22. The nozzle part 21 is formed of, for example, a separate nozzle fitted in the tip of the valve body part 22.

A fuel injection port 21*c* of the injector 20 is formed in the nozzle part 21 on the tip end side of the valve. The nozzle part 21 is mainly constructed of a nozzle body 21*a* having its outside shape formed in a cylinder, and the nozzle body 21*a* has its diameter reduced toward its tip and has a tip end portion 21*b* formed at its extreme tip. The tip end portion 21*b* has a necessary number (for example, 6 to 8) of injection ports 21*c* (small holes) formed therein to connect the inside and the outside of the valve. The nozzle part 21 has a cylindrical nozzle needle 21*d* housed therein. The nozzle needle 21*d* opens or closes a fuel passage connecting to the injection ports 21*c*. The nozzle needle 21*d* is biased to the valve tip end side by a spring 22*a* disposed on the valve rear end side and is slid in the axial direction in the injector 20 by or against the biasing force of the spring 22*a*. In order to prevent an abnormal action, a stopper 22*b* is disposed on the valve rear end side (lift side) of the needle 21*d*.

The high-pressure fuel is fed to the tip end portion 21*b* of the nozzle part 21 from the common-rail (accumulator piping) 12 through the piping 14 (FIG. 1) and a fuel passage 22*c*. The fuel is injected through the injection ports 21*c*, The fuel pressure of the high-pressure fuel is measured at the fuel suction port of the injector 20. Describing in more detail, the pressure value (inlet pressure) that includes the state of pressure variation caused by the injection action or the actual injection (actual fuel injection) of the injector 20 is measured in sequence by the pressure sensor 20*a* disposed at the fuel suction port. When the fuel is injected, the quantity of fuel to be supplied to the injection ports 21*c* and the quantity of fuel per unit time to be injected from the injection ports 21*c* (injection rate) can be changed according to the magnitude of the quantity of upward displacement (lift quantity) in the axial direction of the needle 21*d*. For example, in the state where the needle 21*d* is seated (lift quantity="0"), the fuel injection is stopped.

Next, the internal structure of the valve body part 22 will be described.

The valve body part 22 has a command piston 22*e* disposed in the housing 22*d* forming the cylindrical outside shape of the valve body part 22. The command piston 22*e* is moved in association with the nozzle needle 21*d*. The command piston 22*e* is formed in the shape of a cylinder having a larger diameter than the nozzle needle 21*d* and is connected to the needle 21*d* via a pressure pin 22*f* (connection shaft). The command piston 22*e* is also slid in the injector 20 in the axial direction in the same way as the nozzle needle 21*d*. A command chamber Cd partitioned by the wall surface of the housing and the top surface of the command piston 22*e* is formed on the valve rear end side of the command piston 22*e*. Further, an inlet orifice 22*g* as a fuel inflow port is formed in the command chamber Cd. That is, the high-pressure fuel from the common-rail 12 flows into the command chamber Cd through the inlet orifice 22*g*. In a space below the command piston 22*e*, a leak passage 22*h* for making the space connect to a specified space of the driving part 23 (in detail, a leak space made to connect to the fuel tank 10 when a solenoid valve is opened or closed) is formed. In the injector 20, the leak passage 22*h* is formed to return the extra fuel below the command piston 22*e* (leak fuel or the like from the portion in which the nozzle needle 21*d* is slid) to the fuel tank 10.

The driving part 23 is positioned closer to the rear end side of the valve body part 22. The driving part 23 is mainly constructed of a housing 23*a* having a cylindrical outside shape and has a two-way solenoid valve (TWV) in the housing 23*a*. Describing in detail, the two-way solenoid valve is constructed of an outer valve 23*b*, a spring 23*c* (coil spring), and a solenoid 23*d*.

The two-way solenoid valve opens or closes an outlet orifice 23*e* as a fuel outflow port by the action of the outer valve 23*b*. That is, in the state where current is not passed through the solenoid 23, the two-way solenoid valve is biased to a side in which the outer valve 23*b* closes the outlet orifice 23*e* by the extension force of the spring 23 (extension force along the axial direction). When current is passed through the solenoid valve 23*d* (the solenoid 23*d* is magnetized), the outer valve 23*b* is attracted by the magnetic force of the solenoid 23*d* against the extension force of the spring 23*c*, thereby being displaced to a side to open the outlet orifice 23*e*. On the rear end side of the driving part 23, so as to return the fuel in the housing 23*a*, there is formed a return opening 23*f* (fuel return port). That is, in the injector 20, the return opening 23*f* is made to connect to the fuel tank 10 through piping 18 (see FIG. 1). A circuit for controlling the passing of current through the driving part 23 is mounted in the ECU 30. Programs for performing the injection control through the circuit are stored in the ECU 30.

That is, the ECU 30 controls the current through the two-way solenoid valve by binary values (through a driving pulse) to make the nozzle needle 21*d* perform a lift action according to a current passing time, thereby injecting the high-pressure fuel, which is sequentially supplied to the tip end portion 21*b* through the fuel passage 22*c* from the common-rail 12, through the injection ports 21*c*.

Describing in more detail, when the two-way solenoid valve 23*d* is not energized (OFF state), the outer valve 23*b* is moved down to the valve tip end side to close the outlet orifice 23*e*. When the high-pressure fuel is supplied to the tip end portion 21*b* and the command chamber Cd from the common-rail 12 through the fuel passage 22*c* and the inlet orifice 22*g* in this state, the command piston 22*e* having a diameter larger than the diameter of the lower portion of the nozzle needle 21*d* has a force applied to the valve tip end side on the basis of difference in a pressure receiving area. With this, the command piston 22*e* is pressed down to the valve tip end side, and the nozzle needle 21*d* biased to the valve tip end side by the spring 22*a* shuts the fuel supply passage (the nozzle needle 21*d* is brought into a seated state). For this reason, when the current is not passed, the fuel is not injected (normally closed). The extra fuel below the command piston 22*e* is returned to the fuel tank 10 through the leak passage 22*h* and the return opening 23*f*.

When the current is passed (ON), the outer valve 23*b* is attracted to the valve tip end side by the magnetic force of the solenoid 23*d* to open the outlet orifice 23*e*. When the output orifice 23*e* is opened, the fuel in the command chamber Cd flows out to the fuel tank 10 and the lower side of the command piston 22*e* through the outlet orifice 23*e*, the return opening 23*f*, and the leak passage 22*h*. When the fuel flows out, the pressure in the command chamber Cd and the force to press down the command piston 22*e* are made smaller. With this, the command piston 22*e* is pressed up to the valve rear end side along with the nozzle needle 21*d* integrally connected thereto. When the nozzle needle 21*d* is pressed up (lifted), the nozzle needle 21*d* is separated from its seat to open the fuel supply passage to the injection ports 21*c*, whereby the high-pressure fuel is supplied to the injection ports 21*c* and is injected and supplied to the combustion chamber of the engine through the injection ports 21*c*.

In the injector 20, the passage area of the fuel supply passage to the injection ports 21*c* can be varied according to the lift quantity of the nozzle needle 21*d*, and an injection rate can be also varied according to this passage area. In this case, by variably controlling a parameter (current passing time or fuel pressure) relating to the action of lifting the nozzle needle 21*d*, the injection rate and the injection quantity can be controlled.

Hereinafter, the construction of the system will be further described with reference to FIG. 1.

That is, in this system, a vehicle (not shown) is mounted with various sensors for vehicle control. For example, a crankshaft 41 that is the output shaft of the engine is provided with a crank angle sensor 42 for outputting a crank angle signal at intervals of a specified crank angle (for example, at intervals of 30° CA) so as to detect the rotational angle position and the rotation speed of the crankshaft 41. An accelerator pedal (not shown) is mounted with an accelerator sensor 44 for outputting an electric signal according to the state (quantity of displacement) of the accelerator pedal so as to detect the quantity of operation of the accelerator pedal (the degree of opening of the accelerator) by a driver.

The ECU 30 performs the engine control in this system. The ECU 30 is constructed of a well-known microcomputer (not shown) and grasps the operating state of the engine and user's request on the basis of the detection signal of various sensors and operates various actuators such as the injector 20. The microcomputer mounted in the ECU 30 is basically constructed of various operation devices, storage devices, and communication devices including: a central processing unit (CPU) for performing various operations; a Random Access Memory (RAM) as a main memory for temporarily storing data in the middle of operation and operation results, a Read-Only Memory (ROM) as a program memory; an electrically writable non-volatile memory (EEPROM) as a data storage memory (backup memory) 32; a backup RAM (RAM to which electric power is supplied from a backup power source such as a vehicle-mounted battery); and input/output ports for inputting/outputting a signal to/from the outside. The ROM stores a various kind of programs for controlling the fuel pressure, and the EEPROM 32 stores a various kind of data such as design date of the engine.

In the fuel injection system of this embodiment, the fuel is supplied intermittently from the high-pressure pump 11*b* to the common-rail 12, and the fuel pressure in the common-rail 12 is controlled to a request value. In other words, in the high-pressure pump 11*b* of the fuel pump 11, the action of no-fuel-feeding (suction) and the action of fuel-feeding (discharge) are repeatedly performed. In this case, the fuel pump 11 discharges the fuel from the first plunger 51*a* and the second plunger 51*b*. If the individual difference (deviation of the pneumatic force feeding characteristic) has arisen with each plungers 51*a* and 51*b* regarding the fuel pressure feed, a desired fuel pressure control cannot be performed. For example, if there is a difference between a fuel pumping quantity by the first plunger 51*a* and a fuel pumping quantity by the second plunger 51*b*, the excess and deficiency will arise in fuel pumping quantity. The control precision of fuel pressure will be deteriorated. As a cause of the individual difference between the plungers, a manufacturing dispersion, aging and the like can be considered.

In this embodiment, while detecting individual difference dispersion at the time of fuel pressure feed (deviation in the pumping characteristic) with respect to the first and the second plunger 51*a*, 51*b* of the fuel pump 11, a pumping quantity correction is performed for every plunger in order to cancel the individual difference dispersion. Moreover, especially, the sensor output of the pressure sensor 20*a* attached to each injector 20 is read at a short interval, and the fuel pumping situation in each plungers 51*a* and 51*b* is detected precisely.

Figure 4:
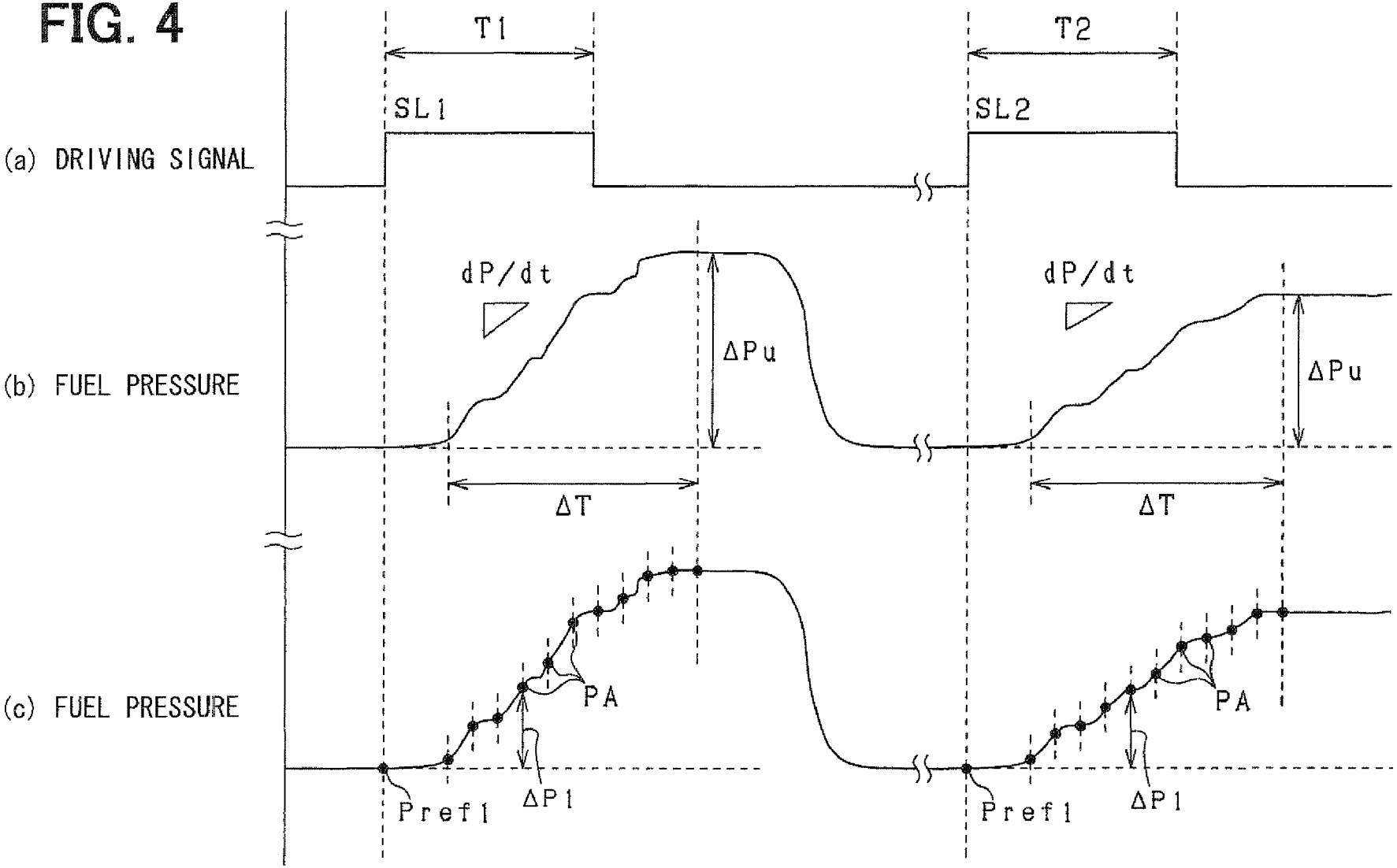
FIG. 4 is a time chart showing a fuel pumping situation for every plunger.

FIG. 4 is a time chart which shows the fuel pumping situation for every plunger at the time of fuel pressure feed. In FIG. 4, a portion (a) shows the driving signal of the fuel pump 11, and a portion (b) and a portion (c) show variation in fuel pressure. A driving signal (SL1) for the first plunger 51*a* and a driving signal (SL2) for the second plunger 51*b* are alternately outputted at a predetermined interval. In FIG. 4, a single fuel pumping by each plungers 51*a* and 51*b* is respectively shown.

In a period T1, the driving signal SL1 for the first plunger 51*a* is outputted about the first plunger 51*a* (referred to as SL1=ON) as shown in the part (a) of FIG. 4 and the fuel pressure varies as shown in the parts (b) and (c). Moreover, in a period T2, the driving signal SL2 for the second plunger 51*b* is outputted (referred to as SL2=ON), and the fuel pressure varies as shown in the parts (b) and (c). Besides, the period T1 is equal to the period T2 in this embodiment. Moreover, after fuel pressure feed, it assumes that the fuel pressure drops due to the fuel injection, whereby the fuel pressure is almost the same at the pressure feed start time of each plunger 51*a*, 51*b*.

When the individual difference has arisen between plungers 51*a* and 51*b*, the difference arises in each fuel pressure variation between plungers 51*a* and 51*b* as shown in the part (b) of FIG. 4. Specifically, the difference arises in a derivative value dP/dt of the fuel pressure after the pressure feed start, a fuel pressure increasing quantity ΔPu, a required time ΔT from a start of variation in fuel pressure to termination of variation, and the like. If the difference arises in the fuel pressure variation between the plungers 51*a* and 51*b*, the difference will arise in the fuel pumping quantity between the plungers 51*a*, 51*b*. The control accuracy of fuel pressure will be deteriorated as a result.

While detecting the variation (fuel pressure waveform) from the fuel pumping start time to the fuel pumping termination time based on the output of the pressure sensor 20*a*, the fuel pumping quantity is computed with respect to every plunger 51*a*, 51*b*, and the individual difference dispersion between the plungers 51*a*, 51*b* are estimated based on the change in the fuel pressure. As shown in the part (c) of FIG. 4, while measuring a fuel pressure Pref1 before the fuel pumping, the fuel pressure PA is successively measured at a prescribed cycle. The variation ΔP1 (=PA−Pref1) of fuel pressure PA relative to the fuel pressure Pref1 is computed, and the variation ΔP1 is integrated to obtain a fuel pumping quantity Q1, Q2 of each plunger 51*a*, 51*b*.

$$Q1(Q2)=K\cdot\Sigma(\Delta P1)$$

wherein K is a conversion factor.

Besides, it is desirable that the fuel pressure Pref1 is measured in a situation that the fuel pressure is stable. For example, the fuel pressure Pref1 is measured at a time when the driving signal rises. Alternatively, the fuel pressure Pref1 can be measured between the rising of the driving signal and an actual increasing of the fuel pressure.

When the individual difference has arisen between plungers 51*a* and 51*b*, the fuel pumping quantity Q1 of the first plunger 51*a* may be different from the fuel pumping quantity Q2 of the second plunger 51*b*. In this case, a pumping correction quantity is computed for every plunger so that fuel pumping quantity may become the same in each plunger 51*a*, 51*b*.

After the pumping start, it is effective to obtain fuel pressure information at a cycle where a transitional variation of fuel pressure can be finely detected. Specifically, a high speed A-D converter is provided in the ECU 30, and the output (detection signal) of the pressure sensor 20 is incorporated through the A-D converter. At this time, the AND conversion cycle is set, for example, to 20 μsec, and fuel pressure PA is computed successively at this cycle. It is desirable that the computing processing of the fuel pressure PA is performed by use of a high-speed operation device such as a digital signal processor (DSP).

The pressure feed start and the pressure feed termination are determined based on the output of the pressure sensor 20*a*. During this period, the pressure variation ΔP1 is integrated to obtain the fuel pumping quantities Q1 and Q2. In this case, when the fuel pressure measured by the pressure sensor 20*a* starts to increase after the driving signal is outputted, it is the time of the pressure feed start. Moreover, when the fuel pressure measured by the pressure sensor 20*a* is shifted from an increasing variation to a constant value, it is the time of the pressure feed termination.

Besides, it is desirable that the output value of the sensor is smoothed by a filter and the pressure feed start timing and the pressure feed termination timing are derived based on the smoothed output value.

On the other hand, when the actual fuel pressure is greater than the target fuel pressure, the pressure-reducing valve 15 is opened to discharge a part of the fuel in the common-rail 12 to the fuel tank 10 through the piping 18. If manufacturing dispersion and aging have arisen in the pressure-reducing valve 15, a deviation of pressure-reducing characteristics causes an error relative to the standard quantity of pressure-reducing. That is, the quantity of pressure-reducing by opening the pressure-reducing valve 15 becomes different from the target quantity of pressure-reducing. As the result, the accuracy of the fuel quantity control may be deteriorated.

According to the present embodiment, while detecting an individual difference dispersion (deviation of pressure-reducing characteristics) of the pressure-reducing valve 15, a pressure-reducing correction is performed in order to cancel the individual difference dispersion. The individual difference dispersion of the pressure-reducing valve 15 is computed based on the output of the pressure sensor 20*a*.

Figure 5:
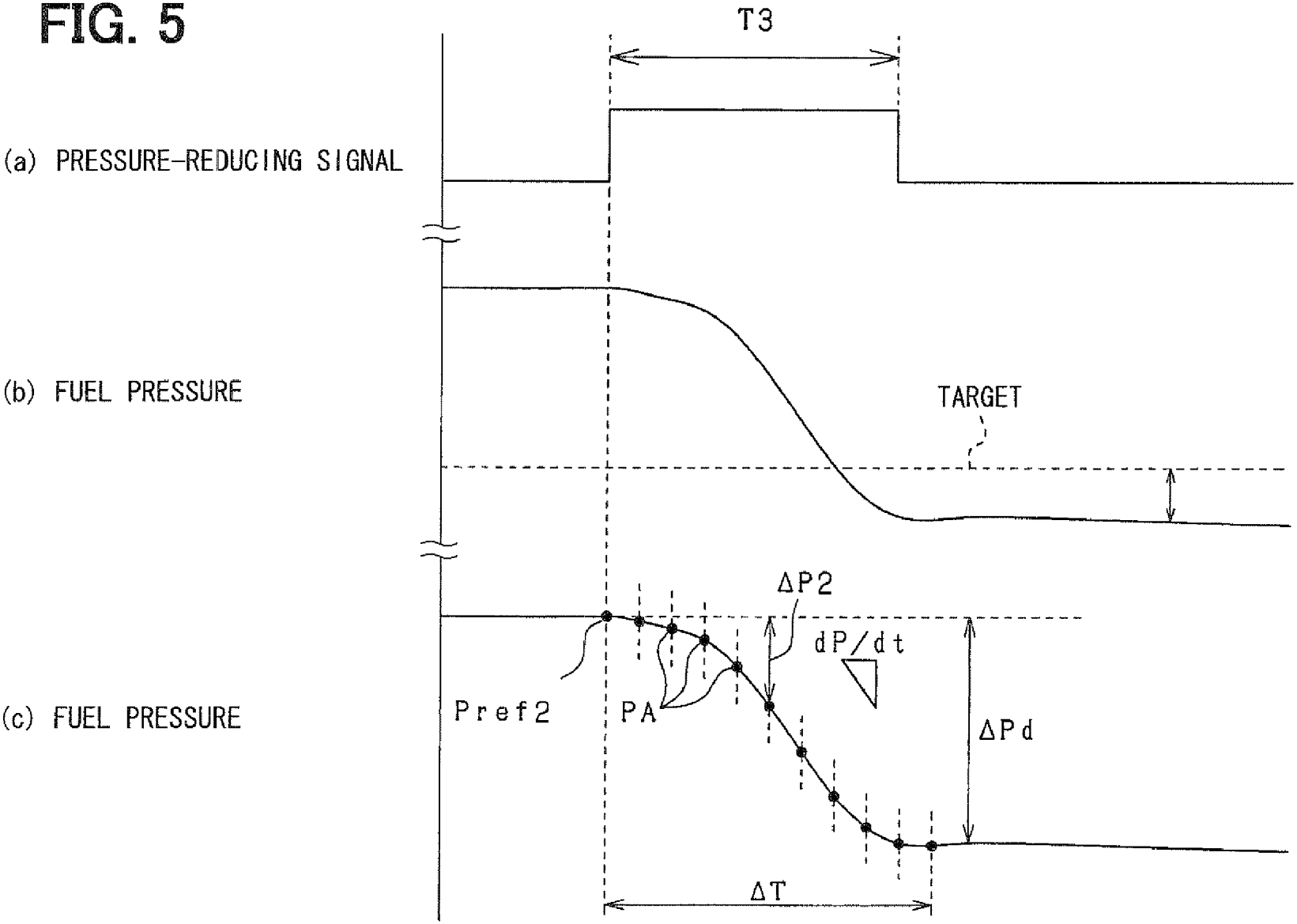
FIG. 5 is a time chart showing a fuel pressure variation at a time when the pressure-reducing valve is operated.

FIG. 5 is a time chart which shows the fuel pressure variation at the time when the pressure-reducing valve 15 is opened. In FIG. 5, a part (a) shows a driving signal (pressure-reducing signal) to the pressure-reducing valve 15, and the parts (b) and (c) show variation in the fuel pressure.

In FIG. 5, in the period T3, the pressure-reducing signal is turned ON to reduce the fuel pressure as shown in the parts (b) and (c). When an individual difference dispersion has arisen in the pressure-reducing valve 15, as shown in the part (b), the fuel pressure after pressure-reducing by the pressure-reducing valve 15 deviates from the desired value. Specifically, the deviation between the fuel pressure and the target fuel pressure causes a dispersion in fuel pressure drop quantity ΔPd. Furthermore, a dispersion arises in the derivative value dP/dt of the fuel pressure after the pressure-reducing start, the required time ΔT from a start of reduction in the fuel pressure to termination of reduction, and the like. In this way, if the pressure-reducing valve 15 shows individual difference dispersion, the control accuracy of fuel pressure will be deteriorated as a result.

While detecting the variation of the fuel pressure (fuel pressure waveform) from the pressure-reducing start time to the pressure-reducing termination time based on the output of the pressure sensor 20*a*, the reducing quantity of the pressure-reducing valve 15 is computed based on the variation of the fuel pressure, and a deviation quantity from a predetermined target reducing quantity is computed. As shown in the part (c) of FIG. 5, while measuring a fuel pressure Pref2 before the fuel pressure-reducing, the fuel pressure PA is successively measured at a prescribed cycle. The variation ΔP2 (=Pref2−PA) of fuel pressure PA relative to the fuel pressure Pref2 is computed, and the variation ΔP2 is integrated to obtain a pressure-reducing quantity Q3 of the pressure-reducing valve 15.

$$Q3=K\cdot\Sigma(\Delta P2)$$

wherein K is a conversion factor.

Besides, it is desirable that the fuel pressure Pref2 is measured in a situation that the fuel pressure is stable. For example, the fuel pressure Pref2 is measured at a time when the pressure-reducing signal rises. Alternatively, the fuel pressure Pref2 can be measured between the rising of the pressure-reducing signal and an actual decreasing of the fuel pressure.

The pressure-reducing start and the pressure-reducing termination are determined based on the output of the pressure sensor 20*a*, During this period, the pressure variation ΔP2 is integrated to obtain the pressure-reducing quantity Q3. In this case, when the fuel pressure measured by the pressure sensor 20*a* starts to decrease after the pressure-reducing signal is outputted, it is the time of the pressure-reducing start. Moreover, when the fuel pressure measured by the pressure sensor 20*a* is shifted from a decreasing variation to a constant value, it is the time of the pressure-reducing termination.

Besides, it is desirable that the output value of the sensor is smoothed by a filter and the pressure-reducing start timing and the pressure-reducing termination timing are derived based on the smoothed output value.

Hereinafter, control of the rotational phase difference by the ECU 40 will be described in detail. The fuel pump 11 is feedback controlled in such a manner that the actual fuel pressure detected by the pressure sensor 20*a* agrees with the target fuel pressure. At this time, the pumping quantity correction is performed for every plunger in order to cancel the individual difference dispersion of the plungers. In a case of the pressure-reducing, a pressure-reducing correction is performed to cancel the individual difference dispersion of the pressure-reducing valve 15.

A quantity of pumping quantity correction and a quantity for pressure-reducing corrections are computed by a correction quantity learning processing, and are stored in the backup memories, such as EEPROM and backup RAM. These values are suitably updated.

Figure 6:
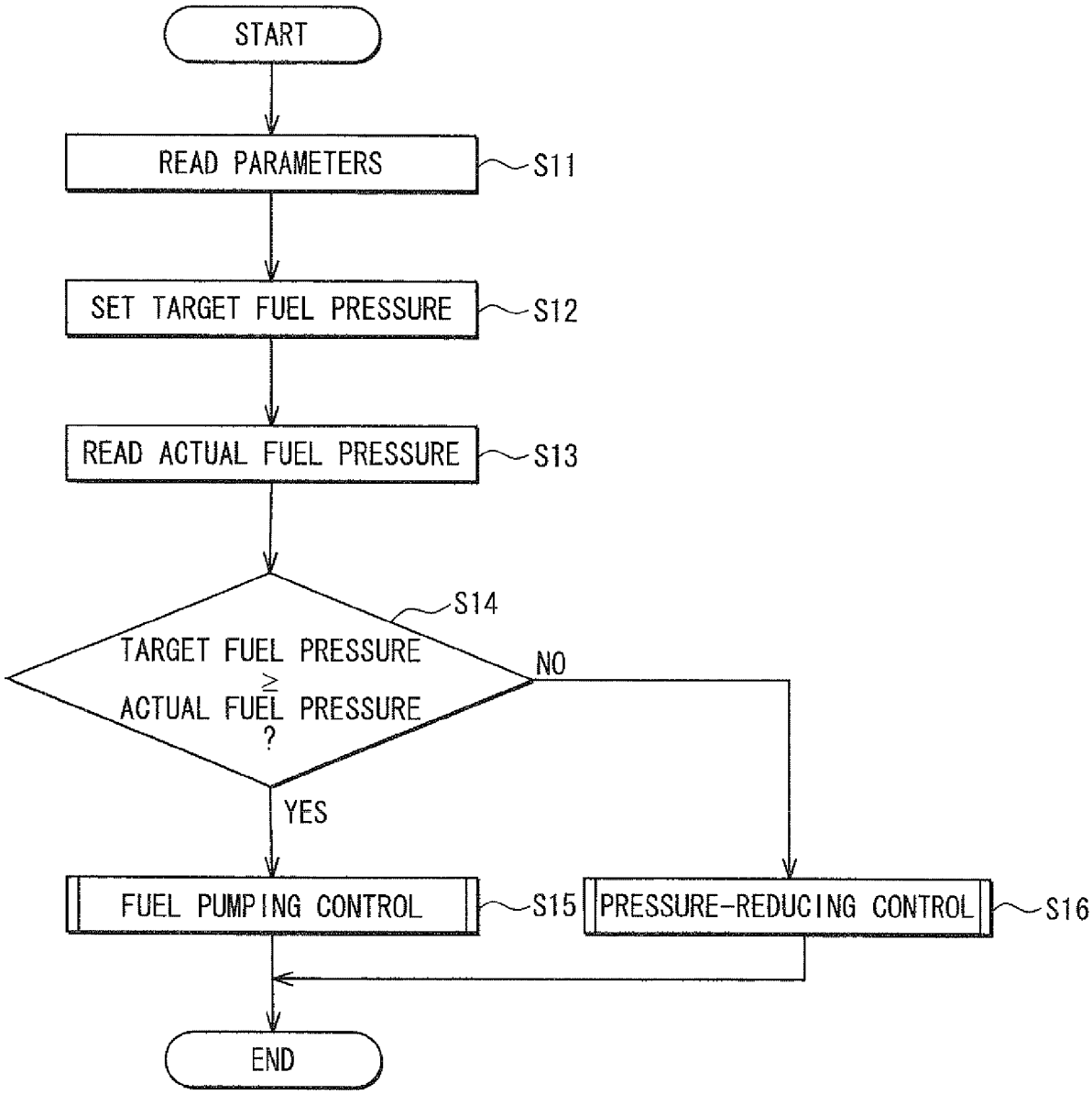
FIG. 6 is a flowchart showing a fuel pressure control processing.

FIG. 6 is a flowchart showing a fuel pressure control processing. This process is performed repeatedly at a predetermined circle.

In step S11, the computer reads parameters regarding the engine driving condition, for example, the engine speed and fuel injection quantity. In step S12, the target fuel pressure is set based on the parameters which are read in step S11. At this time, the target fuel pressure is computed based on the engine speed and the fuel injection quantity by use of a map and a formula previously stored in the ROM. The fuel pressure map indicates a relationship between the parameters and the optimum fuel pressure.

In step S13, the computer reads the actual fuel pressure which is computed based on the output of the pressure sensor 20*a*. At this time, the actual fuel pressure is computed based on each output of the pressure sensor 20*a* provided every injector 20 of each cylinder. Specifically, the actual fuel pressure is derived from an average value of the sensor outputs for all cylinders. Alternatively, when the sensor output of the injection cylinder and the sensor output of the non-injection cylinder are included in the sensor outputs, the actual fuel pressure is computed from the average value of the sensor output of the non-injection cylinder.

In step S14, the computer determines whether the target fuel pressure is greater than or equal to the actual fuel pressure. When the answer is Yes in step S14, the procedure proceeds to step S15 in which the fuel pumping control by the fuel pump 11 (the high-pressure pump 11*b*) is performed. When the answer is No in step S14, the procedure proceeds to step S16 in which the pressure-reducing control by the pressure-reducing valve 15 is performed. When the target fuel pressure is equal to the actual fuel pressure, both of the fuel pumping control and the pressure-reducing control may not be performed to end the processing.

Figure 7A:
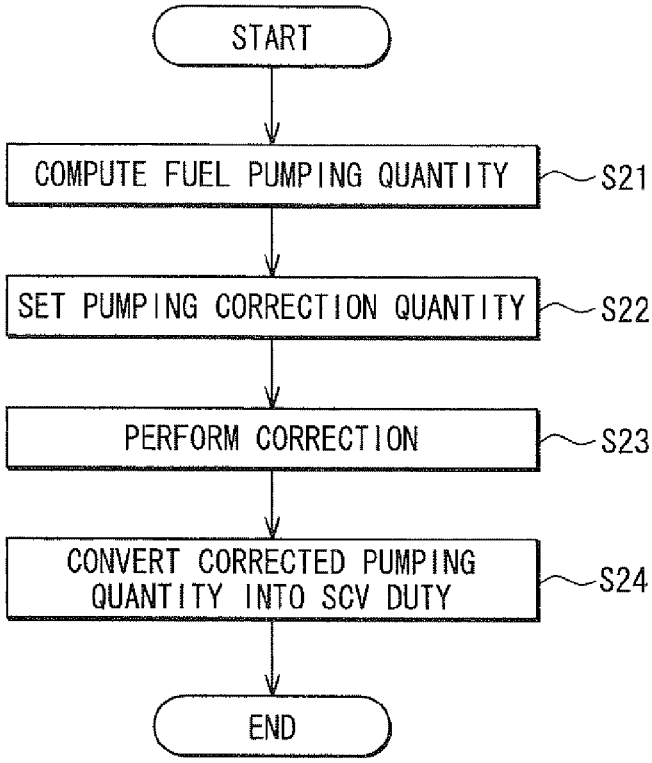
FIG. 7A is a flowchart showing a fuel pumping control processing.

In step S15, while computing the difference between the target fuel pressure and the actual fuel pressure (=target fuel pressure-actual fuel pressure), the fuel pumping control by the high-pressure pump 11*b* is performed based on the pressure difference. Describing the fuel pumping control in detail, as shown in FIG. 7A, the fuel pumping quantity is computed based on the above difference in step S21. In step S22, with respect to the plunger which currently performs the fuel pumping, a pumping correction quantity is derived from the correction quantity data stored in the backup memory. In step S23, a corrected pumping quantity is computed by correcting the current fuel pumping quantity by the pumping correction quantity. In step S24, the corrected pumping quantity is converted into a driving duty of the SCV 11*c* (SCV Duty). Then, the SCV 11*c* is driven by the SCV Duty, whereby the high-pressure pump 11*b* performs a desired fuel pumping.

Figure 7B:
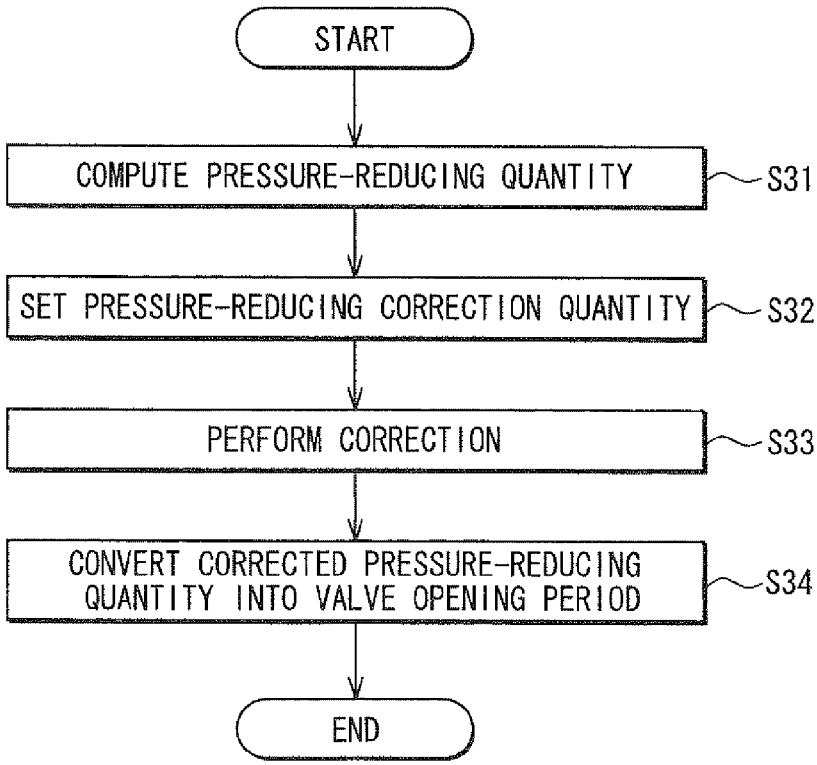
FIG. 7B is a flowchart showing a pressure-reducing control processing.

In step S16, while computing the difference between the target fuel pressure and the actual fuel pressure (=target fuel pressure-actual fuel pressure), the pressure-reducing control by the pressure-reducing valve 15 is performed based on the pressure difference. Describing the pressure-reducing control in detail, as shown in FIG. 7B, the pressure-reducing quantity is computed based on the above difference in step S31. In step S32, a pressure-reducing correction quantity is derived from the correction quantity data stored in the backup memory. In step S33, a corrected pressure-reducing quantity is computed by correcting the current pressure-reducing quantity by the pressure-reducing correction quantity. In step S34, the corrected pressure-reducing quantity is converted into an opening period of the pressure-reducing valve 15. Then, the pressure-reducing valve 15 is opened for the opening period, whereby the pressure-reducing valve 15 performs a desired pressure-reducing.

As a pressure-reducing means, the injector 20 may perform no-injection operation in stead of opening the pressure-reducing valve 15. In the no-injection operation, the solenoid 23*d* is energized for a short period and the fuel is returned to the fuel tank 10 through the fuel return opening 23*f* without performing the fuel injection from the injection port 21*c*.

Figure 8:
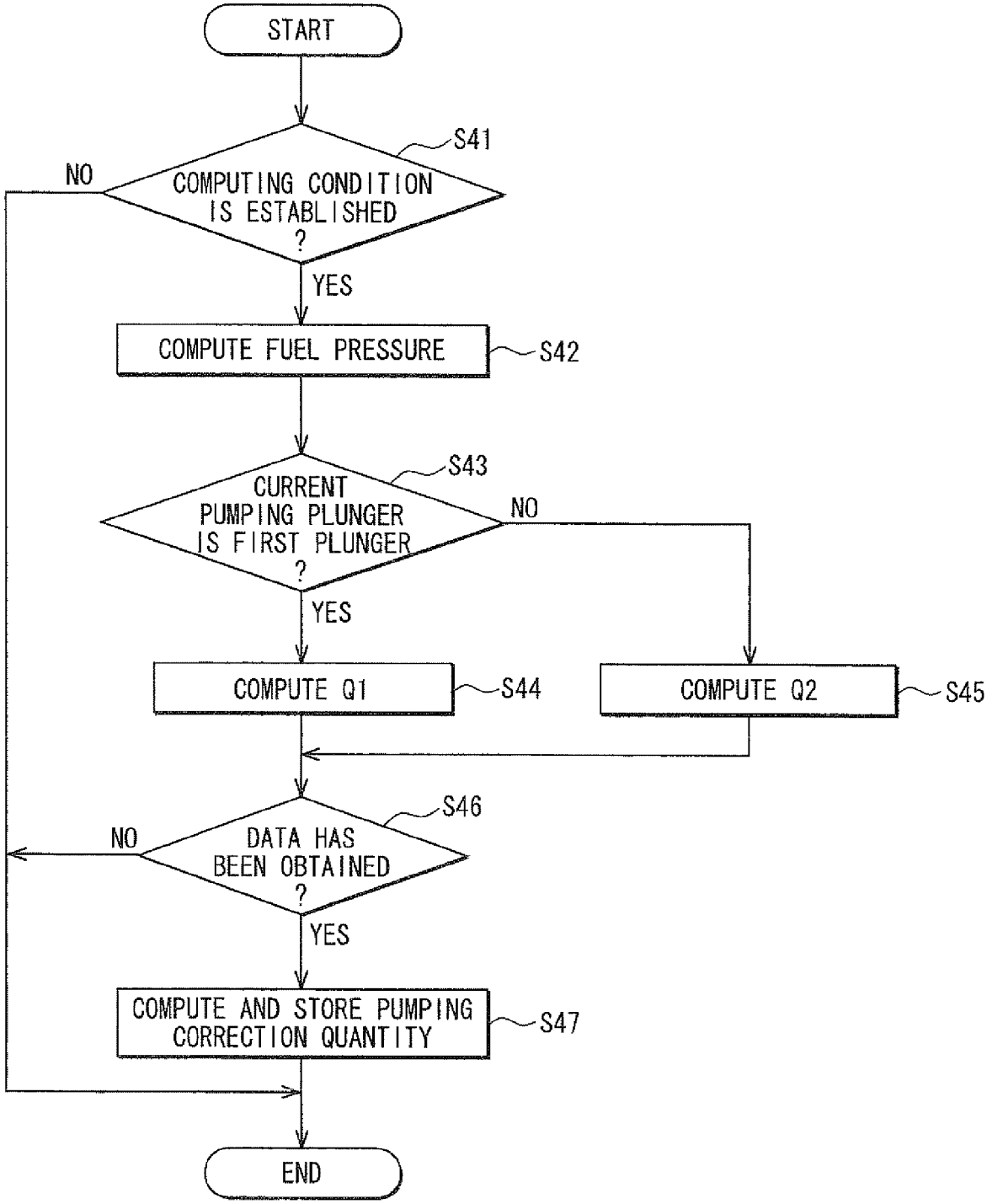
FIG. 8 is a flowchart showing a procedure for computing the pumping correction quantity with respect to plungers.

FIG. 8 is a flowchart showing a procedure for computing the pumping correction quantity with respect to plungers 51*a*, 51*b*. This processing is performed by the ECU30 at the same cycle (20 μsec cycle) as the A/D converting cycle with respect to the output of the pressure sensor 20*a*. Alternatively, this process is performed repeatedly at a predetermined time cycle or a predetermined crank angle cycle.

In step S41, it is determined whether a computing condition of the pumping correction quantity is established. This computing condition includes a condition in which the fuel pressure is stable. For example, when the engine driving condition is stable and the target fuel pressure is a constant value, the computer determines that the computing condition is established.

In step S42, the computer computes the actual fuel pressure based on the output of the pressure sensor 20*a*. At this time, the actual fuel pressure is computed based on each output of the pressure sensor 20*a* provided every injector 20 of each cylinder. Specifically, the actual fuel pressure is derived from an average value of the sensor outputs for all cylinders. Alternatively, when the sensor output of the injection cylinder and the sensor output of the non-injection cylinder are included in the sensor outputs, the actual fuel pressure is computed from the average value of the sensor output of the non-injection cylinder.

In step S43, the computer determines whether a current pumping plunger is the first plunger 51*a*. When the first plunger 51*a* is pumping (the answer is Yes in step S43), the procedure proceeds to step S44. When the second plunger 51*b* is pumping (the answer is No in step S43), the procedure proceeds to step S45. In step S44, an actual fuel pumping quantity Q1 is computed with respect to the first plunger 51*a* based on the fuel pressure computed in step S42. A computing process of the fuel pumping quantity Q1 is explained below.

(1) As shown in the part (c) of FIG. 4, the fuel pressure just before the first plunger 51*a* starts the pumping is defined as the pre-pumping pressure Pref1. For example, the fuel pressure detected at a time when the pump driving signal rises is defined as the pre-pumping pressure Pref1.

(2) During the pumping of the first plunger 51*a*, the pre-pumping pressure Pref1 is subtracted from the fuel pressure PA computed at the predetermined cycle (20 μsec), whereby the pressure variation ΔP1 (=PA−Pref1) is successively computed.

(3) The fuel pumping quantity Q1 of the first plunger 51*a* is computed by integrating the pressure variation ΔP1 during the pumping of the first plunger 51*a*.

In step S45 the actual fuel pumping quantity Q2 is computed with respect to the second plunger 51*b* based on the fuel pressure computed in step S42. A computing process of the fuel pumping quantity Q2 is the same as the above processes (1)-(3). Steps S42-S45 correspond to a pumping pressure detecting means and a pumping characteristic computing means. The fuel pumping quantities Q1 and Q2 correspond to the pumping characteristic.

In step S46, the computer determines whether the actual pumping quantity data of the first plunger 51*a* and the actual pumping quantity data of the second plunger 51*b* have been already obtained. When the answer is No in step S46, the procedure ends. When the answer is Yes in step S46, the procedure proceeds to step S47.

In step S47, the pumping correction quantities of each plunger 51*a*, 51*b* are computed based on the fuel pumping quantities Q1 and Q2 which are computed in steps S44 and S45. The pumping correction quantities are stored as the learning value in the backup memory such as the EEPROM and the backup RAM, Step S47 corresponds to an individual difference learning means. An average of the fuel pumping quantities Q1 and Q2 is computed. The differences between the average and each of the fuel pumping quantities Q1 and Q2 are computed as the pumping correction quantities. If Q1 is greater than Q2, the pumping correction quantity of the first plunger 51*a* is negative value and the pumping correction quantity of the second plunger 51*b* is positive value. That is, the fuel pumping quantity Q1 is decreased and the fuel pumping quantity Q2 is increased.

Since the pumping correction quantity is defined as described above, the pumping quantity correction is performed so that the fuel pumping quantity Q1 becomes equal to the fuel pumping quantity Q2 in step S23.

The pumping correction quantity may be stored in the backup memory in connection with the fuel pressure level at that time.

The pumping correction quantity can be computed according to the following ways.

Between the fuel pumping quantities Q1 and Q2, the larger one is defined as a reference value. The pumping correction quantity is computed with respect to the plunger of which fuel pumping quantity is not the reference value. For example, in a case that Q1 is greater than Q2 and the first plunger 51*a* is defined as the reference, the pumping correction quantity of the first plunger 51*a* is set to "0" and the pumping correction quantity of the second plunger 51*b* is set to a value of "Q1-Q2".

A standard value of the fuel pumping quantity is previously defined, and the differences between the standard value and each of the fuel pumping quantities Q1 and Q2 are computed as the pumping correction quantity.

Figure 9:
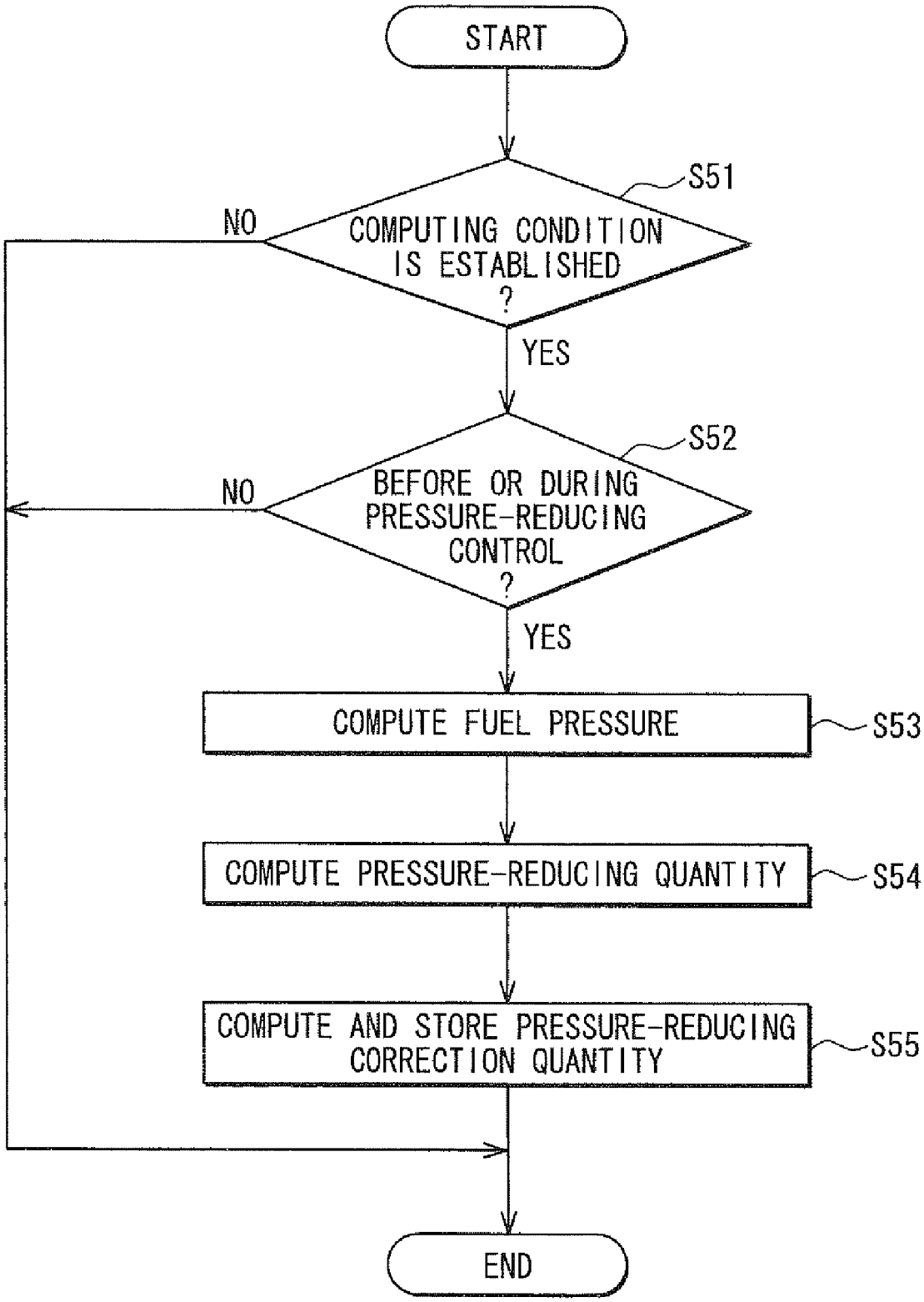
FIG. 9 is a flowchart showing a procedure for computing a pressure-reducing correction quantity.

FIG. 9 is a flowchart showing a computing process of a pressure-reducing correction quantity. This processing is performed by the ECU30 at the same cycle (20 μsec cycle) as the A/D converting cycle with respect to the output of the pressure sensor 20*a*. Alternatively, this process is performed repeatedly at a predetermined time cycle or a predetermined crank angle cycle.

In step S51, it is determined whether a computing condition of the pressure-reducing correction quantity is established. This computing condition includes a condition in which the fuel pressure is stable. For example, when the engine driving condition is stable and the target fuel pressure is a constant value, the computer determines that the computing condition is established.

In step S52, the computer determines whether the pressure-reducing control will be performed from a present time or whether the pressure-reducing control has been performed. When the answer is Yes in step S52, the procedure proceeds to step S53 in which the fuel pressure is computed based on the output of the pressure sensor 20*a*. At this time, the actual fuel pressure is computed based on each output of the pressure sensor 20*a* provided every injector 20 of each cylinder. Specifically, the actual fuel pressure is derived from an average value of the sensor outputs for all cylinders.

In step S54, the actual pressure-reducing quantity Q3 is computed based on the fuel pressure successively computed in step S53. A computing process of the pressure-reducing quantity Q3 is explained below.

(1) As shown in the part (c) of FIG. 5, the fuel pressure just before the pressure-reducing valve 15 starts the pressure-reducing is defined as the pre-reducing pressure Pref2, For example, the fuel pressure detected at a time when the pressure-reducing signal rises is defined as the pre-reducing pressure Pref2.

(2) During the pressure-reducing by the pressure-reducing valve 15, the fuel pressure PA computed at the predetermined cycle (20 μsec) is subtracted from the pre-reducing pressure Pref2, whereby the pressure variation ΔP2 (=Pref2−PA) is successively computed.

(3) The pressure-reducing quantity Q3 is computed by integrating the pressure variation ΔP2 during the pressure-reducing by the pressure-reducing valve 15.

Steps S53 and S54 correspond to a pressure-reducing pressure detecting means and a pressure-reducing characteristic computing means. The pressure-reducing quantity Q3 corresponds to the pressure-reducing characteristic.

In step S55, the pressure-reducing correction quantity is computed based on the pressure-reducing quantity Q3 which is computed in steps S54. The pressure-reducing correction quantity is stored as the learning value in the backup memory such as the EEPROM and the backup RAM. Step S55 corresponds to a pressure-reducing characteristic learning means. In this case, a standard value of the pressure-reducing quantity is previously defined, and the difference between the standard value and the pressure-reducing quantity Q3 is computed as the pressure-reducing correction quantity.

The pressure-reducing correction quantity may be stored in the backup memory in connection with the fuel pressure level at that time.

Figure 10:
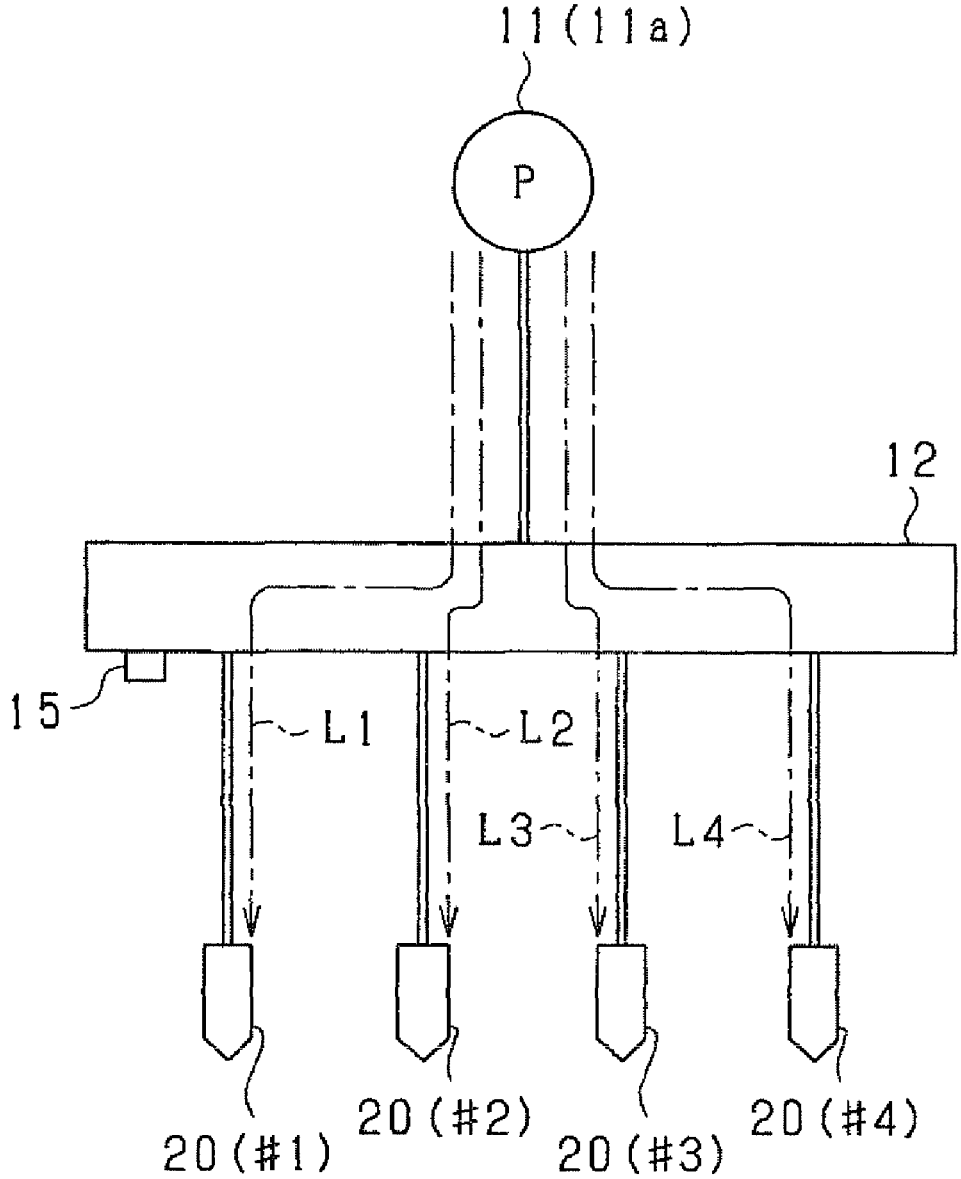
FIG. 10 is a schematic chart showing that a piping length is different between cylinders.

When viewing a fuel path from the fuel pump 11 or the pressure-reducing valve 15 to the injector 20 of each cylinder, the fuel path length (piping length) is different for each of the cylinders. In other words, as shown in FIG. 10, the fuel path lengths L1, L2, L3, and L4 from the fuel pump 11 to the respective cylinders (#1 to #4) are different from each other. With this, the time required for increasing fuel pressure in each cylinder by the injector 20 is made different from each other. The timing when the pressure variation is caused by the pumping of the fuel is made different between the injectors 20 of the respective cylinders. For example, regarding the cylinders #1 and #2, because L1>L2, the detection of the pressure increase by the pressure sensor 20*a* fitted to the injector 20 of the first cylinder (#1) is performed later than the detection by the pressure sensor 20*a* fitted to the injector 20 of the second cylinder (#2).

Thus, in this embodiment, when the fuel pressure is computed at the fuel pumping, the outputs of each pressure sensor 20*a* is synchronized by taking into consideration the differences in the fuel path lengths (L1 to L4) from the fuel pump to the injectors of the respective cylinders, so that a pressure time difference in each cylinder due to the fuel path length can be cancelled. Specifically, it suffices to shift the fuel pressure data, which are acquired in succession, back and forth on the axis of time. For example, with respect to the first cylinder (#1) and the second cylinder (#2), the detection of the fuel pressure data of the second cylinder (#2) is delayed by the difference (L1-L2) in the fuel path length between these cylinders. Alternatively, the detection of the fuel pressure data of the first cylinder (#1) is advanced by the difference (L1-L2) in the fuel path length. Thereby, the fuel pressure (detected pressure) of each cylinder can be properly synchronized on the axis of time.

Besides, when the fuel pressure is computed at a time of the pressure-reducing by the pressure-reducing valve 15, the outputs of each pressure sensor 20*a* is synchronized by taking into consideration the differences in the fuel path lengths (L1 to L4) from the fuel pump to the injectors of the respective cylinders, so that a pressure time difference in each cylinder due to the fuel path length can be cancelled.

According to this embodiment described above, the following advantage can be obtained.

When the fuel is pumping by the plungers 51*a* and 51*b*, the variation in the fuel pressure is successively detected by the pressure sensors 20*a*. Hence, a transitional variation in pressure can be detected with respect to each plunger. Besides, the pumping characteristic is computed with respect to each plunger. Thus, even if an individual difference exists for each plunger, the individual difference can be properly obtained. As the result, the pumping characteristic of the fuel pump 11 (high-pressure pump 11*b*) is improved, so that the emission is also improved.

Based on the pumping characteristic (the fuel pumping quantities Q1 and Q2) of each plunger, the fuel pumping quantity is corrected for every plunger. Even if the individual difference (deviation of the pumping characteristic) has arisen for every plunger, it is possible to cancel the individual difference and to perform the proper fuel pressure feed. The error of the fuel pressure supplied to the injector 20 can be canceled. Especially, the pumping quantity correction is performed so that the fuel pumping quantity becomes the same in each plunger 51*a*, 51*b* under the same pumping condition. Thus, each plunger 51*a*, 51*b* can perform uniform fuel pumping, so that the pressure of the fuel supplied to the injector 20 becomes more stable.

If the injectors inject the fuel in a situation that there is a difference in the fuel pressure due to the individual difference for each plunger, the fuel injection rate is dispersed due to the difference in the fuel pressure. According to this embodiment, the individual difference of each plunger is canceled, so that the disperse of the fuel injection rate is restricted. Therefore, the emission can be improved.

The learning value for every plunger is computed based on the pumping characteristic (the fuel pumping quantity Q1, Q2) of each plunger, and the learning value is stored in the backup memory (the EEPROM 32). When the individual difference (deviation of the pumping characteristic) has occurred regularly for every plunger, the individual difference can be properly obtained and can be reflected suitably for the fuel pumping control.

When the fuel is discharged by the pressure-reducing valve 15, the variation in the fuel pressure is successively detected by the pressure sensors 20*a*. Hence, a transitional variation in pressure due to the pressure-reducing can be detected. Moreover, the pressure-reducing characteristic is computed based on the transitional variation in pressure. Thus, if the pressure-reducing characteristic is deviated, its deviation can be properly detected. As the result, the pressure-reducing characteristic of the pressure-reducing valve 15 can be improved and the emission can be improved.

Based on the pressure-reducing characteristic (pressure-reducing quantity Q3) of the pressure-reducing valve 15, a command value of the pressure-reducing valve 15 is corrected, so that the deviation of the pressure-reducing characteristic can be properly canceled to perform a proper pressure-reducing. The error of the fuel pressure supplied to the injector 20 can be canceled.

The learning value is computed based on the pressure-reducing characteristic (pressure-reducing quantity Q3), and the learning value is stored in the backup memory (the EEPROM 32). When the deviation of the pressure-reducing characteristic has occurred regularly, the deviation of the characteristic can be properly obtained and can be reflected suitably for the pressure-reducing control.

The fuel pressure is detected on the basis of the output of the pressure sensor 20*a* which is integrally fitted to the injector 20. Thus, the fuel pressure can be detected at a position close to the injection openings 21*c* of the injector 20. That is, the pressure of the fuel which is actually injected can be successively detected. Therefore, the fuel pressure varied due to the fuel pumping or pressure-reducing can be correctly detected, and the proper fuel injection can be performed.

The output of the pressure sensor 20*a* is successively acquired at small intervals (at intervals of 20 μsec in the embodiment). That is, the output of the pressure sensor 20 is acquired in such a manner that the trace of the pressure transition waveform can be drawn by the measured pressure. Thus, the transitive pressure variation caused by the fuel pumping or pressure-reducing can be detected suitably.

When the fuel pressure is detected at the time of fuel pumping or pressure-reducing, the differences in the fuel path lengths (L1 to L4) from the fuel pump 11 or the pressure-reducing valve 15 to the injectors 20 of the respective cylinders are considered. Hence, the detection accuracy of the fuel pressure based on the outputs of a plurality of fuel sensor 20*a* can be enhanced.

Since the fuel pressure is determined based on the average of the outputs of a plurality of pressure sensors, the detection accuracy can be enhanced.

Other Embodiment

The present invention is not limited to the embodiments described above, but may be performed, for example, in the following manner.

In the above embodiment, the integral values (Q1, Q2) of the pressure variation quantity ΔP1 with respect to each plunger are computed as the pumping characteristic. This can be changed as follows: For example, the derivative value (dP/dt in FIG. 4) of the fuel pressure after the pumping start is computed as a pumping characteristic. Alternatively, the required time (ΔT in FIG. 4) from a start of variation in fuel pressure to termination of variation can be computed as the pumping characteristic. Alternatively, the fuel pressure increasing quantity (ΔPu in FIG. 4) with respect to each plunger can be computed as the pumping characteristic.

In the above embodiment, the integral value (Q3) of the pressure variation quantity ΔP2 is computed as the pressure-reducing characteristic. This can be changed as follows:

For example, the derivative value (dP/dt in FIG. 5) of the fuel pressure after the pressure-reducing start is computed as a pressure-reducing characteristic. Alternatively, the required time (ΔT in FIG. 5) from the start of pressure-reducing to the termination of pressure-reducing can be computed as the pressure-reducing characteristic. Alternatively, the fuel pressure decreasing quantity (ΔPd in FIG. 5) can be computed as the pumping characteristic.

In the above-mentioned embodiment, (1) the computation processing of the pumping characteristic and the computation processing of the pumping quantity correction with respect to each plunger 51*a*, 51*b*, and (2) the computation processing of the pressure-reducing characteristic and the computation processing of pressure-reducing quantity correction are performed. Alternatively, only one of the processings (1) and (2) may be performed.

A diagnosis of the fuel pump 11 may be performed based on the pumping characteristic which is computed with respect to each plunge 51*a*, 51*b*. If a deviation of the pumping characteristic of each plunger 51*a*, 51*b* is greater than a specified threshold, the computer determines that the fuel pump 11 is faulty. Alternatively, if the pumping characteristic of each plunger 51*a*, 51*b* deviates from a reference value by a specified determination value or more, the computer determines that the fuel pump 11 is faulty. Moreover, based on the pressure-reducing characteristics of the pressure-reducing valve 15, a diagnosis of the pressure-reducing valve 15 can be performed.

In the above embodiment, the fuel pump 11 includes the low-pressure pump 11*a* and the high-pressure pump 11*b* integrally. Alternatively, the low-pressure pump 11*a* and the high-pressure pump 11*b* can be separately structured.

Besides, in the above embodiment, the high-pressure pump 11*b* has tow plungers 51*a*, 51*b* and two compression chambers 54*a*, 54*b* respectively. Alternatively, the high-pressure pump 11*b* may have a single plunger and two compression chambers which are formed at both ends of the plunger.

The high-pressure pump 11*b* has a plurality of cams which reciprocate a plurality of plungers at individual timing.

In the above-mentioned embodiments, the pressure sensor 20*a* is fitted to the fuel suction port of the injector 20, but in addition to this construction, the following constructions can be applied. In short, it suffices for the pressure sensor 20*a* to be fitted downstream of the fuel outlet of the common-rail 12 in the direction of fuel flow in the fuel passage from the common-rail 12 to the injection port of the injector 20. For example, the pressure sensor 20*a* is disposed in the middle of the piping 14 for connecting the common-rail 12 and the injector 20. Alternatively, the pressure sensor 20*a* is disposed in the connection part 12*a* of the common-rail 12 and the piping 14. In this case, it is desirable that the pressure sensor 20*a* is disposed downstream of fuel pulsation reducing means (orifice or the like), which is disposed in the connection part 12*a*, in the direction of the fuel flow. Alternatively, the pressure sensor 20*a* is disposed in the fuel passage arranged in the injector 20 (for example, near the injection openings 21*c* in FIG. 2).

The number of the fuel pressure sensors may be determined arbitrarily, and for example, two or more fuel pressure sensors may be disposed for the fuel passage of one cylinder. In the above-mentioned embodiments, the pressure sensor 20*a* is disposed for each cylinder. However, the pressure sensor is disposed only for a part of the cylinders (for example, one cylinder), and the estimated value based on the output of the sensor may be used for the other cylinders.

A rail pressure sensor for measuring pressure in the common-rail 12 may be provided and the pressure variation due to the pumping by the fuel pump 11 and the pressure-reducing by the pressure-reducing valve 15 may be detected on the basis of the output of the rail pressure sensor. In other words, the pressure variation can be detected by the common-rail pressure sensor employed in the ordinary common-rail type fuel injection system.

A piezo-electrically driven injector may be used in place of the electromagnetically driven injector shown in FIG. 3. A fuel injector not causing a pressure leak, for example, a direct-acting injector not using the command chamber Cd so as to transmit a driving power (for example, direct-acting piezoelectric injector that has been developed in recent years) can be also used. When the direct-acting injector is used, the injection rate can be easily controlled.

A fuel injector may be a valve whose injection opening is opened or closed by a needle or may be an externally opened valve.

While the configuration in which the sensor output of the pressure sensor 20*a* is acquired in succession at intervals of "20 μsec" has been described in the above-mentioned embodiments, the interval of acquiring the sensor output can be changed as appropriate within a range capable of capturing the tendency of the above-mentioned pressure variation. However, according to the experiment made by the inventor, an interval shorter than "50 μsec" is effective.

The kind of the engine to be controlled and the construction of the system can be changed as appropriate according to the use or the like. The present invention can be applied, for example, also to a gasoline engine of a spark ignition type (in particular, direct injection type engine) in the same way. The fuel injection system of a direct injection type gasoline engine is provided with a delivery pipe for storing fuel (gasoline) in a high-pressure state. The fuel is pressure-fed to this delivery pipe from the fuel pump, and the high-pressure fuel in the delivery pipe is injected and supplied to the combustion chamber of the engine.

In this system, the delivery pipe corresponds to an accumulation container. The apparatus and the system according to the present invention can be used for the controlling of the fuel injection pressure of not only the fuel injector for directly injecting the fuel into the cylinder but also the fuel injector for injecting the fuel into an intake passage or an exhaust passage of the engine. A fuel injector is not limited to the injector shown as an example in FIG. 3. An arbitrary type of injector can be used. When the construction is changed in this manner in the above-mentioned embodiments, it is preferable that the details of the above-mentioned various kinds of processing (programs) are changed into an appropriate optimal mode according to the actual construction.

In the above-mentioned embodiments and their modifications, it is thought that various kinds of software (programs) are used. However, the same function may be realized by hardware such as an exclusive circuit.

What is claimed is:

1. A controller for an accumulator fuel injection system provided with a fuel pump which has a plurality of fuel pumping systems in which a suction and a discharge of a fuel are repeatedly performed at an individual timing along with a rotation of an engine output shaft, the accumulator fuel injection system provided with an accumulator in which the fuel supplied from the fuel pump is accumulated, the accumulator fuel injection system provided with a fuel injector which injects the fuel in the accumulator, the controller comprising:

a pumping pressure detecting means for successively detecting a variation in a fuel pressure in a fuel passage between the fuel pump and the fuel injector at a respective time of a fuel pumping in the fuel pumping systems; and a pumping characteristic computing means for computing a pumping characteristic with respect to each fuel pumping system based on the variation in the fuel pressure detected by the pumping pressure detecting means; wherein the accumulator fuel injection system includes a fuel pressure sensor disposed downstream of a fuel outlet of the accumulator in a fuel passage from the accumulator to an injection port of the fuel injector;

the fuel injector is provided to each cylinder of a multicylinder engine, the fuel injector performs an fuel injection in a specified order thereof, the fuel pressure sensor is provided to each cylinder; and the pumping pressure detecting means detects the variation in the fuel pressure based on an output of the fuel pressure sensor provided to the cylinder in which no fuel injection is currently performed.

2. A controller according to claim 1, further comprising:

a pumping quantity correction means for correcting a command pumping quantity at the time of fuel pumping with respect to each of the fuel pumping systems based on the pumping characteristic of each fuel pumping system computed by the pumping characteristic computing means.

3. A controller according to claim 2, wherein the pumping quantity correction means corrects the command pumping quantity so that a fuel pumping quantity becomes equal to each other in the fuel pumping systems under an identical pumping condition.

4. A controller according to claim 1, further comprising an individual difference learning means for computing a learning value indicative of an individual difference of each of the fuel pumping systems based on the pumping characteristic of each fuel pumping system computed by the pumping characteristic computing means, and storing the learning value.

5. A controller according to claim 1, wherein the pumping pressure detecting means detects the variation in the fuel pressure in consideration of differences in the fuel path lengths from the fuel pump to a pressure measuring point by the fuel sensor.

6. A controller according to claim 1, wherein the pumping pressure detecting means detects the variation in the fuel pressure based on an average value of the outputs of a plurality of fuel pressure sensors.

7. A controller according to claim 1, wherein the pumping characteristic computing means computes an integrated value of a pressure variation quantity indicative of a difference between the fuel pressure before a fuel pumping and the fuel pressure during the fuel pumping with respect to each fuel pumping system, and the pumping characteristic computing means computes the pumping characteristic with respect to each fuel pumping system based on the integrated value.

8. A controller according to claim 1, wherein the pumping characteristic computing means computes a variation rate of the fuel pressure after the fuel pumping is started with respect to each fuel pumping system, and the pumping characteristic computing means computes the pumping characteristic of each fuel pumping system based on the variation rate of the fuel pressure.

9. A controller according to claim 1, wherein the pumping characteristic computing means computes a required time from a pressure increase by a fuel-pumping-start to a pressure convergence by a fuel-pumping-termination with respect to each fuel pumping system, and the pumping characteristic computing means computed the pumping characteristic of each fuel pumping system based on the required time.

10. A controller according to claim 1, wherein the accumulator fuel injection system includes a pressure-reducing valve for discharging the fuel in the accumulator to reduce the fuel pressure therein, the controller further comprising:

a pressure-reducing pressure detecting means for successively detecting a variation in a fuel pressure in a fuel passage between the accumulator and the fuel injector at a time of pressure-reducing by the pressure-reducing valve;

a pressure-reducing characteristic computing means for computing a pressure-reducing characteristic of the pressure-reducing valve based on the variation in the fuel pressure detected by the pressure-reducing pressure detecting means.

11. A controller according to claim 10, further comprising:

a pressure-reducing quantity correction means for correcting a command pressure-reducing quantity at the time of pressure-reducing based on the pressure-reducing characteristic computed by the pressure-reducing characteristic computing means.

12. A controller according to claim 10, further comprising a pressure-reducing characteristic learning means for computing a learning value indicative of a deviation of the pressure-reducing characteristic based on the pressure-reducing characteristic computed by the pressure-reducing characteristic computing means, and storing the learning value.

13. A controller according to claim 10, wherein the accumulator fuel injection system includes a fuel pressure sensor disposed downstream of a fuel outlet of the accumulator in a fuel passage from the accumulator to an injection port of the fuel injector, and the pressure-reducing pressure detecting means detects the variation in the fuel pressure at a time of discharging the fuel by the pressure-reducing valve on the basis of an output of the fuel pressure sensor.

14. A controller according to claim 13, wherein the fuel injector is provided to each cylinder of a multicylinder engine, the fuel injector performs an fuel injection in a specified order thereof, the fuel pressure sensor is provided to each cylinder, and the pressure-reducing pressure detecting means detects the variation in the fuel pressure in consideration of differences in the fuel path lengths from the pressure-reducing valve to the fuel pressure sensor with respect to each pressure sensor disposed on each cylinder.

15. A controller according to claim 10, wherein the pressure-reducing pressure detecting means detects the variation in the fuel pressure based on an average value of the outputs of a plurality of fuel pressure sensors.

16. A controller according to claim 10, wherein the pressure-reducing characteristic computing means computes an integrated value of a pressure variation quantity indicative of a difference between the fuel pressure before a pressure-reducing and the fuel pressure during the pressure-reducing, and the pressure-reducing characteristic computing means computes the pressure-reducing characteristic based on the integrated value.

17. A controller according to claim 10, wherein the pressure-reducing characteristic computing means computes a variation rate of the fuel pressure after the pressure-reducing is started, and the pressure-reducing characteristic computing means computes the pressure-reducing characteristic based on the variation rate of the fuel pressure.

18. A controller according to claim 10, wherein the pressure-reducing characteristic computing means computes a required time from a pressure drop by a pressure-reducing-start to a pressure convergence by a pressure-reducing-termination, and the pressure-reducing characteristic computing means computes the pressure-reducing characteristic based on the required time.

19. A method of controlling an accumulator fuel injection system provided with a fuel pump which has a plurality of fuel pumping systems in which a suction and a discharge of a fuel are repeatedly performed at an individual timing along with a rotation of an engine output shaft, the accumulator fuel injection system provided with an accumulator in which the fuel supplied from the fuel pump is accumulated, the accumulator fuel injection system provided with a fuel injector which injects the fuel in the accumulator, the method comprising:

successively detecting a variation in a fuel pressure in a fuel passage between the fuel pump and the fuel injector at a respective time of a fuel pumping in the fuel pumping systems; and computing a pumping characteristic with respect to each fuel pumping system based on the variation in the detecting fuel pressure; wherein the accumulator fuel injection system includes a fuel pressure sensor disposed downstream of a fuel outlet of the accumulator in a fuel passage from the accumulator to an injection port of the fuel injector;

the fuel injector is provided to each cylinder of a multicylinder engine, the fuel injector performs an fuel injection in a specified order thereof, the fuel pressure sensor is provided to each cylinder; and the detecting of the variation in the fuel pressure is based on an output of the fuel pressure sensor provided to the cylinder in which no fuel injection is currently performed.

20. A method according to claim 19, wherein the detecting of the variation in the fuel pressure is performed in consideration of differences in the fuel path lengths from the fuel pump to a pressure measuring point by the fuel sensor.

* * * * *